US011131087B2

(12) United States Patent
Sonovani

(10) Patent No.: US 11,131,087 B2
(45) **Date of Patent: *Sep. 28, 2021**

(54) TOILET CLEANING DEVICES SYSTEMS AND METHODS

(71) Applicant: KILLER WHALE L.T.D, Tel Aviv (IL)

(72) Inventor: Binyamin Yefet Sonovani, Qatsrin (IL)

(73) Assignee: KILLER WHALE L.T.D, Tel Aviv (IL)

( * ) Notice: Subject to any disclaimer, the term of this patent is extended or adjusted under 35 U.S.C. 154(b) by 40 days.

This patent is subject to a terminal disclaimer.

(21) Appl. No.: 16/567,189

(22) Filed: Sep. 11, 2019

(65) Prior Publication Data

US 2020/0002929 A1 Jan. 2, 2020

Related U.S. Application Data

(63) Continuation of application No. 16/322,607, filed as application No. PCT/IL2018/050601 on Jun. 4, 2018, now Pat. No. 10,494,803.

(60) Provisional application No. 62/514,854, filed on Jun. 4, 2017.

(51) Int. Cl.

| | |
|---|---|
| ***E03D 9/02*** | (2006.01) |
| ***E03D 9/03*** | (2006.01) |
| *E03D 9/00* | (2006.01) |

(52) U.S. Cl.

CPC ..... *E03D 9/02* (2013.01); *E03D 9/032* (2013.01); *E03D 9/005* (2013.01); *E03D 2009/028* (2013.01)

(58) Field of Classification Search

CPC ..... E03D 9/02; E03D 9/032; E03D 9/005; E03D 2009/024; E03D 2009/028

USPC ..... 4/232

See application file for complete search history.

(56) References Cited

U.S. PATENT DOCUMENTS

| | | | | |
|---|---|---|---|---|
| 6,898,806 | B2 * | 5/2005 | Keramidas | E03D 9/032 4/223 |
| 8,510,872 | B2 * | 8/2013 | Muhlhausen | E03D 9/032 4/223 |
| 10,494,803 | B2 * | 12/2019 | Sonovani | E03D 9/032 |
| 2001/0031091 | A1 * | 10/2001 | Kondo | H04N 11/042 382/238 |
| 2004/0031091 | A1 | 2/2004 | Landesberg et al. | |
| 2005/0273918 | A1 * | 12/2005 | Bernarducci | E03D 9/032 4/231 |
| 2008/0028505 | A1 * | 2/2008 | Penn | E03D 9/007 4/231 |

(Continued)

*Primary Examiner* — Huyen D Le

(74) *Attorney, Agent, or Firm* — Browdy and Neimark, PLLC

(57) ABSTRACT

A device is provided for cleaning a toilet having a toilet bowl, the device including a treatment unit including a housing having a cavity configured and enabled to collect and store flushing tank fluids of said toilet flowing via one or more openings in said housing, one or more cleaning materials, a spraying unit including one or more spraying devices, wherein the spraying devices are configured and enabled to spray said flushing tank fluids mixed with the cleaning materials via the one or more spraying devices into an interior of the toilet bowl, one or more pumps for drawing the flushing tank fluids mixed within the treatment unit with the one or more cleaning materials to the spraying unit.

20 Claims, 23 Drawing Sheets

(56) References Cited

U.S. PATENT DOCUMENTS

| | | | | |
|---|---|---|---|---|
| 2010/0192291 | A1* | 8/2010 | Burt | E03D 9/022 4/223 |
| 2011/0173742 | A1* | 7/2011 | Leo | E03D 9/032 4/223 |
| 2011/0302704 | A1* | 12/2011 | Frey | E03D 9/032 4/223 |
| 2011/0302705 | A1* | 12/2011 | Frey | E03D 9/005 4/223 |
| 2012/0110722 | A1* | 5/2012 | Abbondanzio | B65D 83/267 4/223 |
| 2012/0266920 | A1* | 10/2012 | Burt | E03D 9/005 134/24 |

* cited by examiner

TOILET CLEANING DEVICES SYSTEMS AND METHODS

CROSS-REFERENCE

The present application claims priority to U.S. Provisional Application Ser. No. 62/514,854 filed on Jun. 4, 2017, entitled "TOILET CLEANING DEVICES SYSTEMS AND METHODS" which is incorporated herein by reference in its entirety.

INCORPORATION BY REFERENCE

All publications, patents, and patent applications mentioned in this specification are herein incorporated by reference to the same extent as if each individual publication, patent, or patent application was specifically and individually indicated to be incorporated by reference.

FIELD OF THE INVENTION

The present invention relates to toilet treatment devices, systems and methods, more particularly to an automatic and autonomous water and energy saving devices and methods for cleaning, deodorizing and disinfecting toilets.

BACKGROUND OF THE INVENTION

Toilets and specifically flush toilets are the most common sanitation fixtures used in the western world for disposal of human urine and feces. A typical flush toilet includes a ceramic bowl (pan) connected to a cistern (tank) that enables rapid filling with water and to a drain pipe for removing the effluent.

Naturally, toilets bowls and specifically bowls of public toilets require fundamental and frequent cleaning and sanitization to prevent bacteria growth and contaminations. Traditionally, toilet bowls have been cleaned, deodorized and disinfected by manual scrubbing with a liquid or powdered cleaning and sanitizing agent. In order to eliminate the manual scrubbing, various toilet bowl cleaner dispensers have been proposed.

One of the popular toilet bowl cleaner dispensers include aerosol deodorizing and/or cleaning agent that is dispensed into a toilet bowl through a conduit attached to the toilet bowl rim. Another well-known toilet bowl cleaners examples include automatic toilet bowl treatment devices. Such automatic devices include fluid reservoir, a pump, and a hanger means such that the entire device may be suspended from a part of a toilet bowl.

An example of a Dispenser device is illustrated in US Patent Application No. 2011/0302705 entitled "Dispenser device in particular a we rinser with fixing means" to Frey et al. The application relates to a release device, in particular toilet freshener, for releasing at least one preparation into the interior of a toilet bowl comprising a dispenser, at least one container connected to the dispenser for storing at least one preparation, a release element for releasing preparation, in particular into the interior of a toilet bowl, the release element being connected in communicating manner to the container via a line and the bottom of the container being arranged above the release orifice of the release element in the direction of gravity, such that a difference in level $\Delta h$ is formed between the bottom of the container and the release orifice of the release element.

Another example of a dispenser is illustrated in US Patent Application No. 2004/0031091 entitled "Toilet rim dispenser for colored liquid" to Landesberg et al. A liquid rim dispenser intended for suspension from a rim of a toilet bowl adjacent a wall thereof, in the path of flushing water during a flushing operation, comprises a basin with a basin wall and a basin bottom having a bottom opening and a cup with a cup wall and a cup bottom fixed within said basin. The dispenser further comprises a container with a colored staining liquid having a discharge opening facing the bottom of the cup with a predetermined clearance therebetween. The dispenser is so configured that the discharge opening is lower than the cup wall, and the bottom opening is lower than the cup wall and is located remote from the wall of the toilet bowl, and at least when the dispenser is suspended from the bowl rim, the bottom opening is higher than a low portion of the basin bottom.

The prior toilet cleaning instruments can be less than ideal in at least some respects. First, the cleaning and disinfection end result of prior cleaning solutions is incomplete leaving uncleaned areas and areas which were not sufficiently disinfected. Specifically, areas which are not in proximity to the cleaning instrument are typically left unclean. Second, known cleaning devices are insufficient requiring multiple washing cycles till the toilet bowl is properly cleaned. As a result, large amount of water and detergent are wasted resulting in non-saving (e.g. 'non-green') device and system. Third, prior devices require external energy support such as electricity connection to improve the instrument efficiency. Forth, the cost of prior toilet cleaning instruments can be greater than would be ideal. Fifth, the prior toilet cleaning instruments can be somewhat bulky, difficult to operate and the cleaning instrument parts require professional handling than would be ideal in at least some instances. Six, the prior toilet cleaning methods and devices require permanent human intervention, sometimes every 3 or 4 hours, such as refilling the cleaning containers, and cleaning specific areas which were not sufficiently cleaned by the cleaning device.

It would therefore be desirable to provide an improved, cheap and easily producible and autonomous toilet cleaning device.

It would therefore be desirable to provide a cleaning device not hinging on external power resources.

It would be further desirable to provide improved, and low-cost integrated cleaning toilet instrument that overcomes at least some of the aforementioned problems with the prior art.

SUMMARY OF INVENTION

In one aspect there is provided a toilet cleaning device comprising a storage and control unit, comprising: at least one container, said at least one container is configured to store one or more cleaning materials of a first type for cleaning or sanitizing said toilet; one or more pumps for delivering via one or more pipes said one or more cleaning materials of a first type; and one or more power sources; a treatment unit, said treatment unit comprising: a housing having a cavity configured and enabled to collect and store flushing tank fluids of said toilet flowing via one or more openings in said housing; one or more cleaning materials of second type; a spraying unit, comprising one or more spraying devices, wherein said spraying devices are configured and enabled to spray said flushing tank fluids mixed with the cleaning materials of a second type via the one or more spraying devices into to the interior of a toilet bowl; one or more pumps for drawing said flushing tank fluids mixed within the treatment unit with the one or more cleaning materials of the second type to the spraying unit; a rotatable spraying unit configured to: receive the one or more cleaning materials of the first type from said one or more pipes; rotate perpendicularly in respect to said treatment unit length at the said toilet bowl cavity; and spray said one or more cleaning materials of the first type at said toilet bowl cavity; a bridge unit connectable to said treatment unit and said treatment unit, said bridge unit is configured and enabled to be hung on said toilet bowl rim and hold said treatment unit away and below the toilet bowl rim at the path of the toilet flushing water.

In many embodiments, the device comprising one or more sensors said sensors are configured and enabled to collect data relating to said toilet or said toilet surrounding;

one or more processing units and or timers are configured to: receive the data from said one or more sensors;

process the data relating to the toilet or the toilet surrounding conditions and operate the spraying devices or the rotatable spraying unit to provide said first type and second type cleaning materials according to the processed data.

In many embodiments, the data comprises one or more indications of a presence of an object or a user in proximity to the device or the toilet bowl and the one or more processing units and/or timers are configured to activate the spraying devices or the rotatable spraying unit once the user is not in the vicinity of the toilet.

In many embodiments, the sensors are selected from the group consisting of: proximity sensors; pressure sensors; RF sensors; IR sensors; laser sensors; biologic sensors; image sensors; spectroscopic sensors; sensors configured to detect smell, PH sensors.

In many embodiments, the device comprises one or more indicator units.

In many embodiments, said one or more indicator units are mechanical indicators units or electronic indicator units.

In many embodiments, the electronic indicator units comprise one or more lights.

In many embodiments, the one or more indicator units are configured to present the status of the device.

In many embodiments, the one or more indicator units are configured to present the status of the one or more containers.

In many embodiments, the one or more indicator units are configured to present a number of use cycles left to activate the device or use the at least one container.

In many embodiments, the one or more indicators are configured to present the one or more power sources status.

In many embodiments, the one or more spraying devices or rotatable spraying unit comprises a spray nozzle.

In many embodiments, said spray nozzle is configured and enabled to rotate or move.

In many embodiments, the one or more processing and/or timer units are configured to initiate a first cleaning process according to one or more indications received from said sensors.

In many embodiments, the processing units are configured to initiate a second cleaning process following said first cleaning process or according to one or more indications received from said sensors.

In many embodiments, said first cleaning process comprises: activating the spraying unit; and spraying fluids and cleaning materials into the toilet bowl.

In many embodiments, the first type of cleaning materials are sprayed as follows: a. cleaning and whiting materials b. anti-stick materials c. foamy materials d. coloring materials e. perfuming materials.

In many embodiments, said second cleaning process comprises activation said rotatable spraying unit.

In many embodiments, said second cleaning process comprises spaying one or more sanitization materials.

In many embodiments, the device comprises hydropower means to provide power to said cleaning device.

In many embodiments, the hydropower means comprise a dynamo unit for producing hydroelectricity to charge the power source.

In many embodiments, said hydropower means further comprises one or more rotating coils of wire to convert mechanical rotation into a pulsing direct electric current.

In many embodiments, said rotating coils are wheels.

In many embodiments, said wheels are connected to said bridge unit.

In many embodiments, said wheels are configured to be completely or partially inserted to said treatment unit cavity.

In many embodiments, said wheels are octagonal shaped.

In many embodiments, said bridge unit comprises one or more pivots for rotating said wheels and wherein said wheels comprise a number of cavities and blades which are mounted around the circumferential rim of the wheels to prevent the escape of water from the ends of the cavities.

In many embodiments, the device comprises a stepping motor or a rotary motor.

In many embodiments, the rotatable spraying unit comprises a sprinkler, said sprinkler is coupled to the distal end of the external pipe for spraying the sanitization or cleaning materials to the toilets or to the toilets surroundings.

In many embodiments, the treatment unit comprises an elongated groove and wherein said rotatable spraying unit is embedded within said elongated groove.

In many embodiments, said rotatable spraying unit is attached to said treatment unit bottom.

In many embodiments, said treatment unit comprises at least one treatment container, said at least one treatment container is configured and enabled to collect and store fluids, wherein said fluids are toilet flushing tank fluids.

In many embodiments, the bridge unit comprising: a second spraying unit configured and enabled to spray cleaning materials via a plurality of nozzle on said toilet seat or toilet space.

In many embodiments, the device comprising: a proximity sensor; and a pressure sensor; a timer, said timer is configured to activate the spraying unit to a predefined time interval once an indication is received from the pressure sensor for sanitizing the toilets.

In many embodiments, the proximity sensor is configured to prevent the activation of the sanitization cleaning process once the proximity sensor identifies a user or an object in the toilets or in proximity to the toilets.

In many embodiments, the device comprising one or more indicators configured to check the flushing fluid flowing level.

In many embodiments, the rotating coils are configured to measure or indicate the toilet flushing fluid flowing level or speed according to said rotating coils speed.

In many embodiments, the indicated flushing fluid flowing speed is transmitted to the processing unit for accordingly activating the spraying unit or the rotatable spraying unit.

In another aspect, there is provided a method for autonomously cleaning a toilet bowl, the method comprising: providing a cleaning device, and wherein a processing unit is configured and enabled to receive movement or pressure indication from said sensors and operate said spraying units to spray fluids on said interior surface of a toilet bowl according to said sensors indications.

In another aspect, there is provided a method for autonomously cleaning a toilet bowl, the method comprising: providing a cleaning device, wherein a processing unit is configured and enabled to operate said spraying units according to a cleaning matrix.

In many embodiments, the cleaning matrix comprises dividing the toilet to a number of sections represented by the cleaning matrix and wherein the processing steps may include identifying one or more specific sections of the matrix sections which require additional or specific treatment according to the identified status of the section.

In another aspect, a device for autonomously cleaning toilet comprises: a storage and control unit, comprising: at least one container, said at least one container is configured to store one or more cleaning materials of a first type for cleaning or sanitizing said toilet; one or more pumps for delivering via one or more pipes said one or more cleaning materials of a first type; and one or more power sources; a treatment unit, said treatment unit comprising: a housing having a cavity configured and enabled to collect and store flushing tank fluids of said toilet flowing via one or more openings in said housing; one or more cleaning materials of the second type; a spraying unit, comprising one or more spraying devices, wherein said spraying devices are configured and enabled to spray said flushing tank fluids mixed with the cleaning materials of a second type via the one or more spraying devices into the interior of a toilet bowl; one or more pumps for drawing said flushing tank fluids mixed within the treatment unit with the second type of cleaning materials to the spraying unit; a rotatable spraying unit configured to: receive cleaning materials of a first type from said one or more pipes; rotate perpendicularly in respect to said treatment unit length at the toilet bowl cavity; and spray said cleaning materials of a first type at said toilet bowl cavity; a bridge unit connectable to said treatment unit and said treatment unit, said bridge unit is configured and enabled to be hung on said toilet bowl rim and hold said treatment unit away and below the toilet bowl rim at the path of the toilet flushing water; a pressure sensor; a proximity sensor; one or more processing units comprising instructions to: activate the spraying unit according to one or more indications received from the pressure sensor; and activate the rotatable spraying unit according to one or more indications received from the proximity sensor.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks, according to embodiments of the invention, could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein, are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data.

BRIEF DESCRIPTION OF THE DRAWINGS

The subject matter disclosed may best be understood by reference to the following detailed description when read with the accompanying drawings in which.

DETAILED DESCRIPTION

Figure 1A:
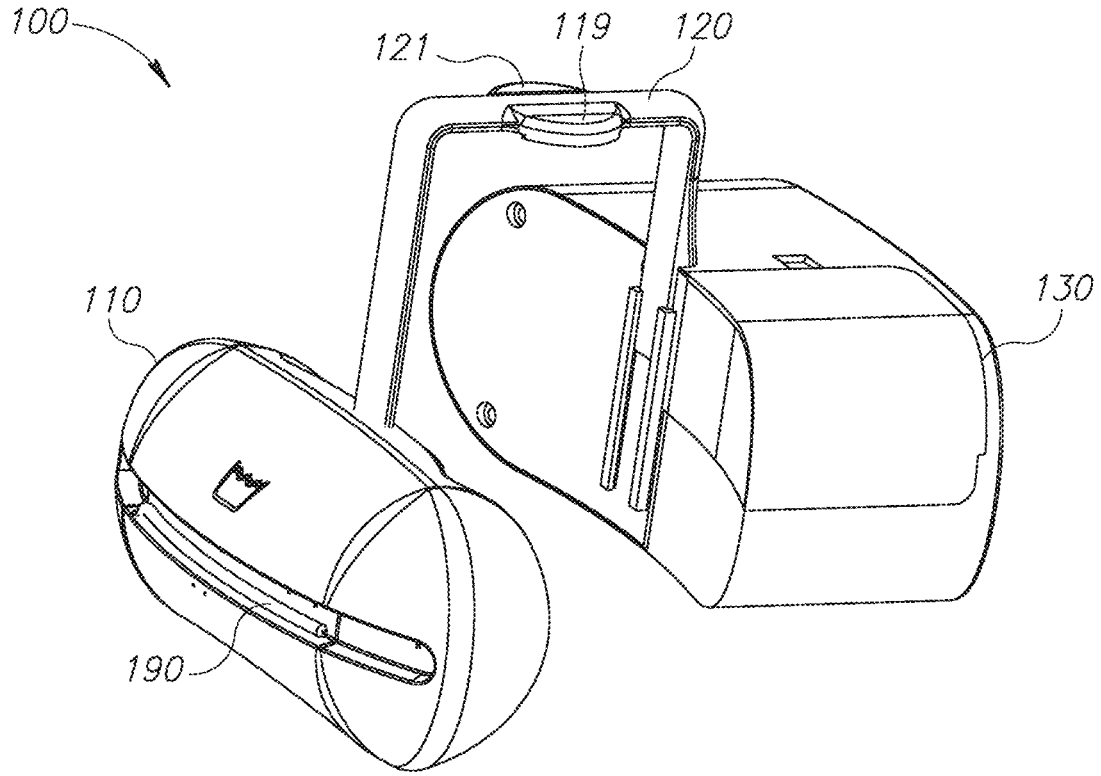
FIG. 1A shows an isometric upper side view of the cleaning device, in accordance with configurations.

As explained above, the present invention relates to toilet treatment devices, systems and methods, more particularly to automatic and autonomous smart toilet cleaning devices, comprising water and energy saving capabilities. The systems and devices are configured to clean toilets including, for example, deodorizing and/or sanitization of toilets, for example, a toilet seat, toilet bowl, toilet space and the like.

Prior to the detailed description of the invention being set forth, it may be helpful to set forth definitions of certain terms that will be used hereinafter.

As used herein the term 'toilet' encompasses a device that may be used to collect one or more biological waste products of a user.

As used herein the term 'user' encompasses human or animal that deposits bodily waste into an embodiment of the toilet disclosed herein.

As used herein the term "cleaning matrix" as used herein and through the specification and claims should be understood to encompass one or more predefined cleaning procedures, such as one or more types of cleaning according to for example the toilet condition (e.g. clean/dirty) such as sanitization, foaming etc.

The term "cleaning" as used herein and through the specification and claims should be understood to encompass a process of removing dirt, treatment, or washing dirt. In some cases, the cleaning process includes deodorizing and/or sanitization such as a toilet seat sanitization.

As used herein like characters identify like elements.

In accordance with some embodiments there is provided a toilet cleaning device such as a modular and autonomous cleaning device comprising a processing unit for automatically and autonomously controlling one or more cleaning and/or spraying units for cleaning and/or deodorizing and/or sanitization the toilet such as the inner surface of toilet bowl, the toilet seat, toilet space and toilet surrounding and other locations in the toilets vicinity.

In some cases, the device may autonomously clean the toilets, such as public toilets, and or the toilets surrounding, once it is installed with no need for an external manual interference or control such as human support and/or human control. For example, the device may be automatically set up for use by placing it on the toilet (e.g. in the toilet bowl or on the toilet rim), in a 'plug and play' fashion and once the device is positioned at the toilets it may autonomously initiate a cleaning procedure which includes cleaning and/or deodorizing and/or disinfecting the toilets according to for example a cleaning matrix.

In some cases, the automatic and autonomous activations are performed using one or more sensors such as proximity sensors, for detecting the presence and/or location of a user in the toilets.

In accordance with embodiments, the device units, such as the batteries and cleaning containers may be easily releasable from the device and inserted back to the device. For example, the units may include a frame or other units which can positively engage the body and/or frame to ensure that a suitable seal has been secured and may provide an audible or physical "click" type confirmation.

In some cases, the device and/or the device units are sealable. For example, the device housing is configured to include one or more sealable containers such as releasable sealable containers. The containers may include a container body, lid, a gasket and a locking arm. The container body includes a lip defining an opening. The lip includes a sealing portion and an engaging portion. More specifically the housing is configured so dirt and other cleaning materials will not leak into the device housing or from one unit to another.

In some cases, the device includes one or more units for preventing the removal of the device from the toilets, for example, once it was first attached or placed at the toilets it may not be removed.

In some cases, the cleaning device comprises an integrated power generation unit configured and enabled to autonomously recharge the cleaning device power source.

In some cases, the device is configured to be automatically disabled and not perform a cleaning procedure if a user is at the toilets or at the vicinity of the toilet.

The cleaning device further comprises at least one spraying unit configured and enabled to autonomously and/or automatically clean one or more locations at the toilets according to data received from one or more sensors. Specifically, the device comprises a first spraying unit configured to clean the toilet bowl inner surface and a second spraying unit configured to clean the toilet seat and the toilet space and surrounding, for example simultaneously. The spraying units may comprise one or more spraying devices such as spouts or nozzles that may automatically move or rotate, for example in 360 degrees and control the direction and flow of liquid (e.g. cleaning treatments) from the device's spouts.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Figure 1B:
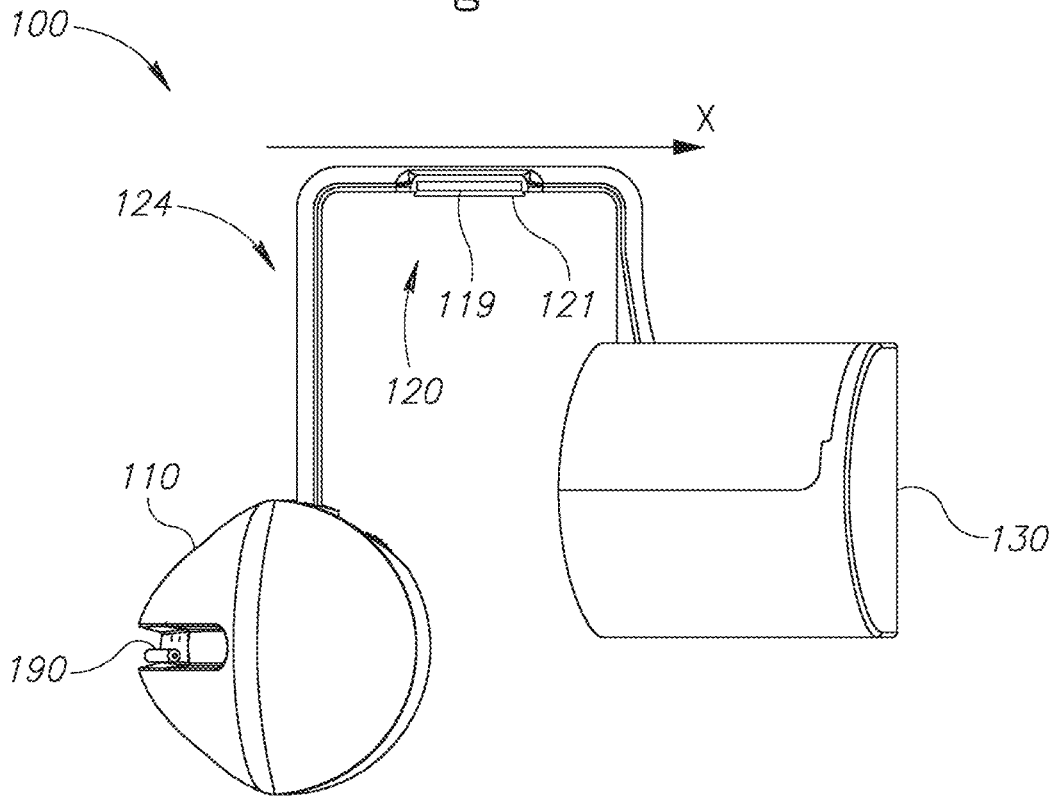
FIG. 1B shows an isometric side view of the cleaning device, in accordance with configurations.

Reference is made to FIGS. 1A-1B illustrating a cleaning device 100 for automatically and/or autonomously cleaning toilets, in accordance with some embodiments. FIG. 1A shows an isometric upper side view of the device 100, FIG. 1B shows an isometric side view of the device 100. According to some embodiments, the device 100 may be modular including for example three main units: a treatment unit 110, a bridge unit 120 and a storage and control unit 130.

In some cases, the three units are formed and connected as of one piece, alternatively, the treatment unit 110 and the bridge unit 120 are formed or connected together as one piece and the bridge unit is connectable to the storage and control unit 130.

In accordance with embodiments, the treatment unit 110 may comprise one or more fluid reservoirs or containers, cleaning agents and materials, one or more cleaning and spraying units. The treatment unit 110 is configured to collect and receive fluids such water flushing from the toilet's flush tank and cleaning treatments such as detergents received for example from the storage and control unit 130 or cleaning materials placed at the treatment unit 110, and form a chemical mixture from the received fluids and cleaning treatment. The chemical mixture is then sprayed for example automatically along the perimeter surface of the toilet bowl.

According to some embodiments, the treatment unit 110 comprises a spraying arm 190, shaped for example as an elongated pipe. In some cases, the spraying arm 190 is positioned externally to the treatment unit and is configured to rotate in perpendicular to the treatment unit 110 length. In some cases, the spraying arm 190 is configured to deliver and disperse cleaning material, such as materials including sanitization agents from the storage and control unit 130 and spray the materials into the interior of the toilet.

In accordance with embodiments, the device 100 comprises hanger means such as a bridge unit 120 (e.g. suspension unit) configured to be hung for example on a toilet bowl rim and hold the treatment unit 110 away from the toilet bowl, for example below the toilet rim at the path of the flushing water, thus water flushing during flushing operation on the sidewalls of the toilet bowl surface will be efficiently accumulated by the one or more fluid reservoirs or containers of the treatment unit 110.

The cleaning device 100 further comprises a storage and control unit 130 for storing cleaning materials or compositions such deodorizing and disinfecting materials (e.g. detergents) which may be dispensed by the treatment unit 110 into the toilet bowl.

In some cases, the storage and control unit 130 includes control and processing means such as one or more processing units for processing data received from one or more sensors of the device and/or external sensors which are in communication with the device 100 and/or external devices such as computer devices or smart mobile phone devices or the like. Based on the processed data the processing units are configured to operate and control the device units, such as the spraying units.

In some cases, the device, for example, the storage and control unit 130, may include one or more timers for activating the device units, such as the one or more spraying units.

According to some embodiments, the sensing units may include one or more sensors such as proximity sensors and/or pressure sensors for detecting a movement of a user at the device's vicinity and accordingly activating or deactivating the device. The sensors may be for example RF sensors, IR sensors, pressure sensors, laser sensors. In some cases, the sensors may be sensors configured and enabled to detect smells in proximity to the cleaning device. In some cases, the sensors may be sensors of Interlink Electronics FSRTM 400 series. The sensors may include Force Sensing Resistors, or FSRs. The sensor may be a round sensor 18.28 mm in diameter.

In some cases, the proximity or motion sensor may be HC-SR505 Mini PIR motion sensor or other known motion sensors which are based on infrared technology and may automatically control by itself with high sensitivity and high reliability. (see for example http://www.elecrow.com/hcsr505-mini-pir-motion-sensor-p-1382.html)

Figure 2A:
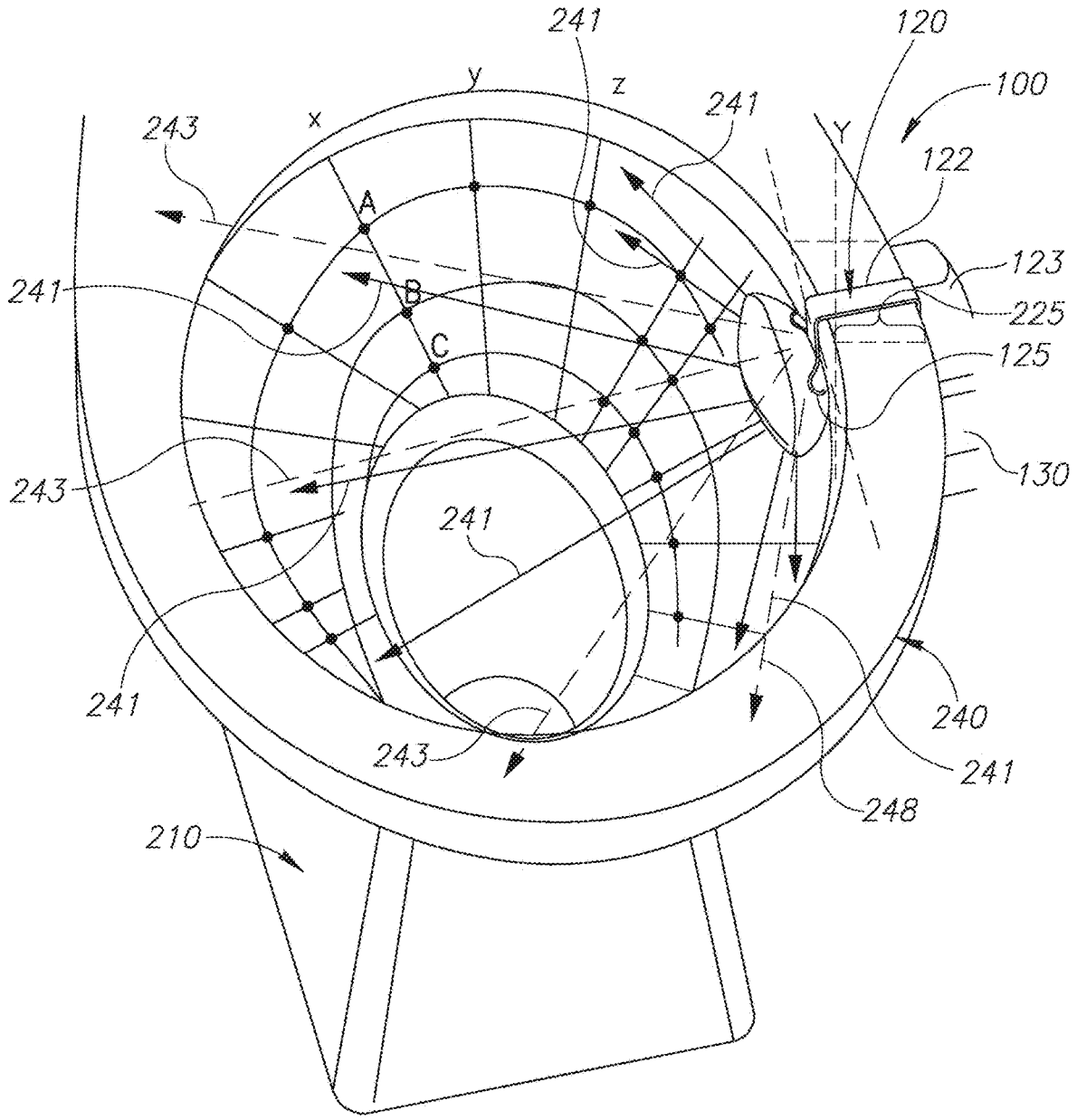
FIG. 2A shows a top side isometric view of the device hung on a toilet bowl rim, in accordance with configurations.
Figure 2B:
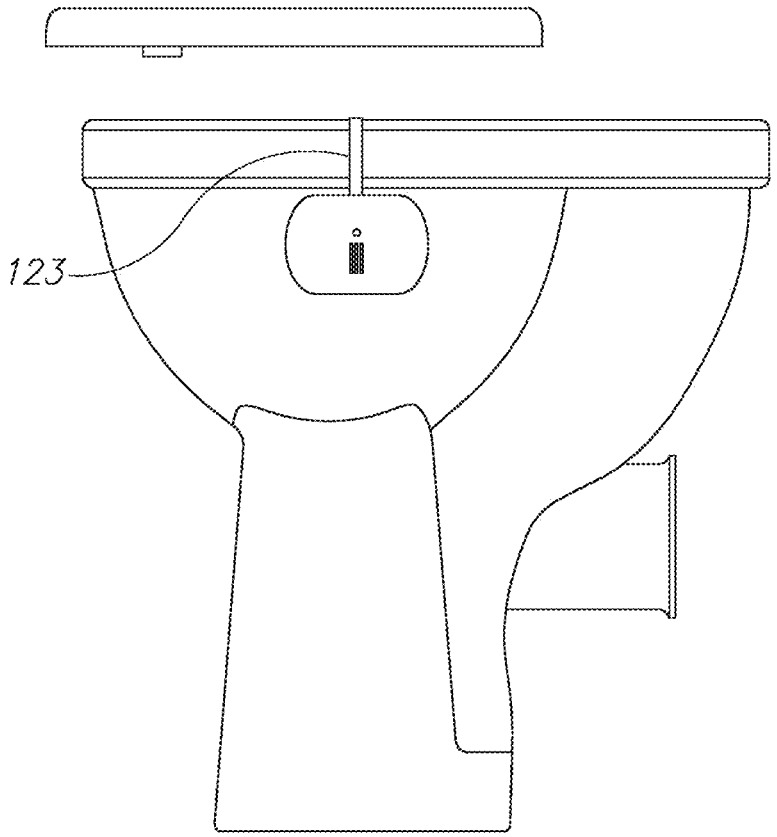
FIGS. 2B and 2C show a side and top views of the device hung on a toilet bowl rim, in accordance with configurations.

In some cases, the storage and control unit 130 is positioned exterior to the toilet bowl, for example below the toilet bowl rim as shown in FIG. 2A-2B. In some cases, the external unit may be placed in any other location.

In accordance with embodiments, the bridge 120 may be made of strong and flexible materials such as plastic, polymer, still or any known elastic material.

In accordance with other embodiments, the bridge 120 may be made of one piece and the bridge portions extending from the sides of the bridge base may be perpendicular, or substantially perpendicular (e.g. around 90-60 degrees) in respect to an X axis.

In accordance with some embodiments, the bridge may include an elongated section, for example extending from the center section 121 of the bridge having a rounded shape for stabling and holding the device on the toilet bowl rim.

In accordance with some embodiments, one or more sensors may be embedded in the bridge unit such as a proximity sensor, pressure sensor or a sensor configured to identify or be activated once a contact or pressure is identified. For example, a sensor 119 may be embedded at the center section for identifying and sensing a pressure or movement of a user such as user seating on the toilet seat.

In accordance with another embodiment, one or more sensors such as a proximity sensor may be attached to the treatment unit 110 for example at top side of the treatment unit 110 or may positioned within the treatment unit for identifying movements in proximity to the device.

Figure 1C:
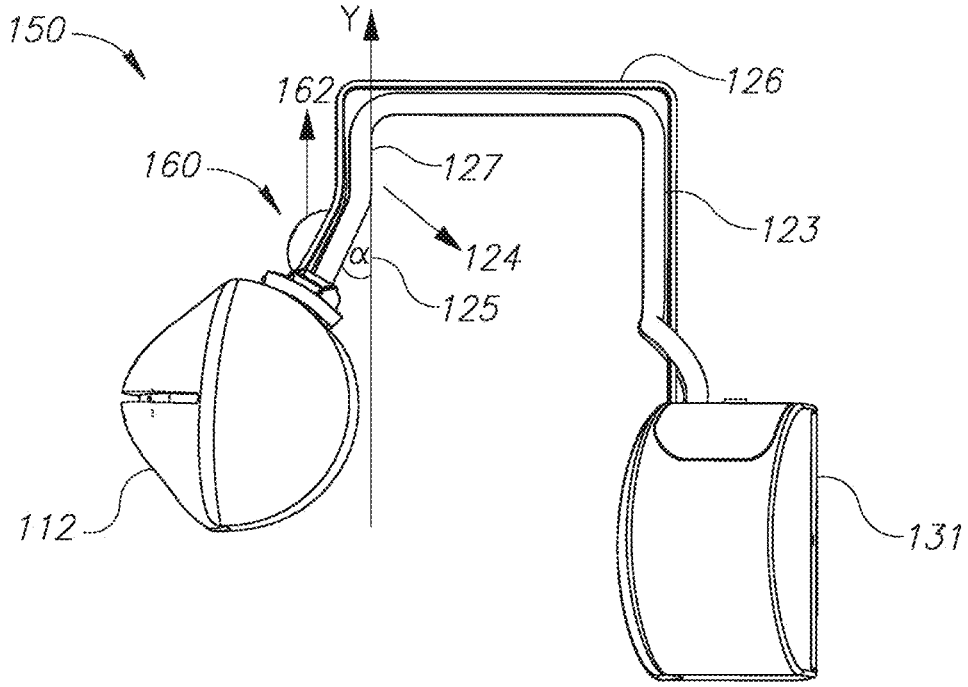
FIGS. 1C and 1D show another isometric side and top view of a cleaning device, in accordance with configurations.
Figure 1D:
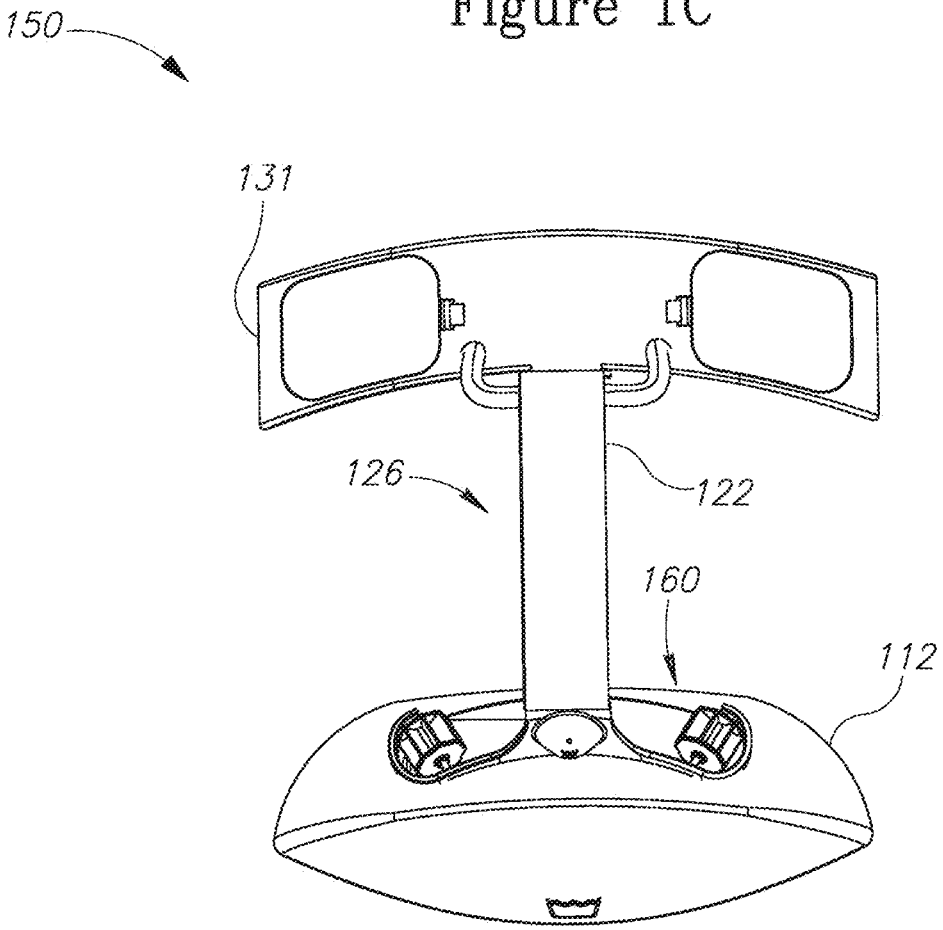

Reference is made to FIGS. 1C-1D illustrating a cleaning device 150 for automatically and/or autonomously cleaning toilets, in accordance with another embodiment. FIG. 1C shows an isometric side view of the device 150, FIG. 1D shows an isometric top view of the device 150.

According to some embodiments, the device 150 includes a power generator unit 160 for converting mechanical energy into electrical current. In some cases, the power generator unit 160 may be connected for example to bridge unit 126 and is further configured to transfer and/or form power for recharging the device's power source (e.g. batteries) as will illustrated herein below.

According to some embodiments, the bridge 126 comprises one or more indication units 162 such as one or more warning and status lights or small speakers to indicate the device 150 mode, e.g. sleep/active mode etc.

Figure 1E:
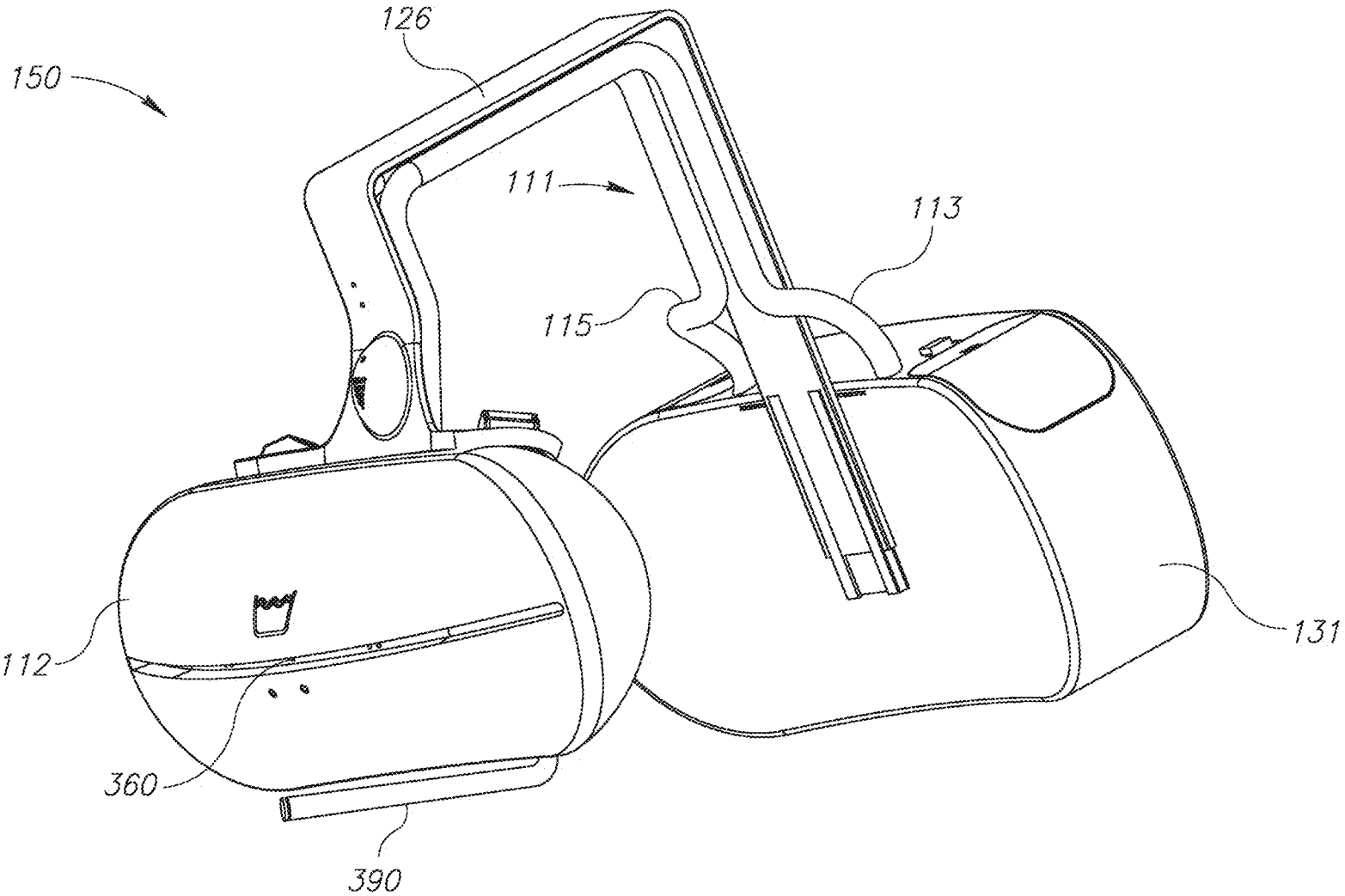
FIGS. 1E-1F show another isometric view of the cleaning device, in accordance with configurations.
Figure 1F:
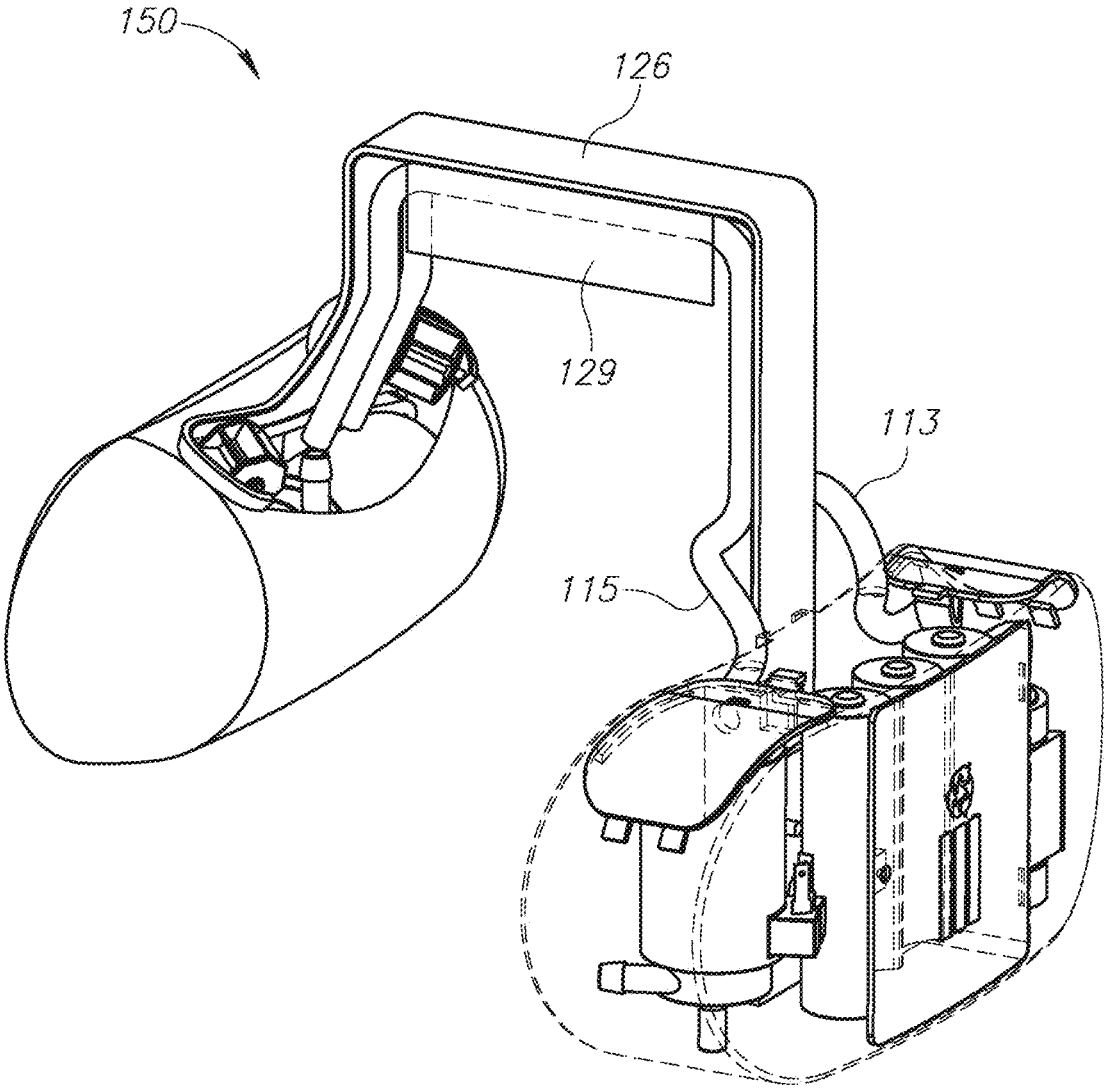

FIGS. 1E-1F show another isometric views of the cleaning device 150, in accordance with embodiments. The cleaning device 150 comprises one or more pipes 111 for delivering the cleaning compositions from the storage unit 131 to the treatment unit 112 for example for supplying cleaning agents and/or fluids to the spraying units such as sparing unit 360 and/or spraying arm 390. In some cases, the pipes 111 may be external or partially external to the device 150. According to some embodiments the cleaning device 150 may comprise two separated pipes. A first pipe 113 may be connected at one end to one of the device's containers for example to a first container such as container 479 comprising liquid and a second pipe 115 may connected at one end to a second container comprising foaming material. The other ends of the first and second pipes may be attached or coupled to the inner portion of the treatment unit 112.

The external portions of the pipes 113 and 115 may be coupled or attached to the back side of the storage unit 131 and to the inner section of the bridge 126. According to some embodiments, the pipes are flexible and the external portions of the pipes are bended along the bridge shape to avoid overhanging. The pipes are further inserted to the treatment unit and are connected vie one or more openings to the pumps for spraying the fluids and/or cleaning materials to the toilet or to the toilet's surroundings.

According to some embodiments, one of the pipes such as pipe 113 may deliverer sanitization materials to the external sparing arm 390 via one or more pipes for sparing the interior of a toilet as illustrated in FIG. 4K, while the other pipe such as pipe 115 may deliver cleaning material which may be mixed with fluids aggregated at the treatment unit and sprayed via one or more pipes and nozzles of spraying unit 360 for cleaning the toilet bowl surface as illustrated in FIG. 2A.

According to some embodiments, as shown in FIG. 1F the bridge 126 may comprise a hanging protection 129 located under the flat stripe section to avoid the pipes crushing by the toilet seat or to avoid any unwanted pressure on the pipes.

In some cases, the bridge 126 may comprise a double sealing cover wall and the pipes may be placed inside the cover. In some case a 'built in' bridge comprising one or more pipes may be provided.

In some cases, the pipes may be made of plastic or other materials as known in the art.

Figure 1G:
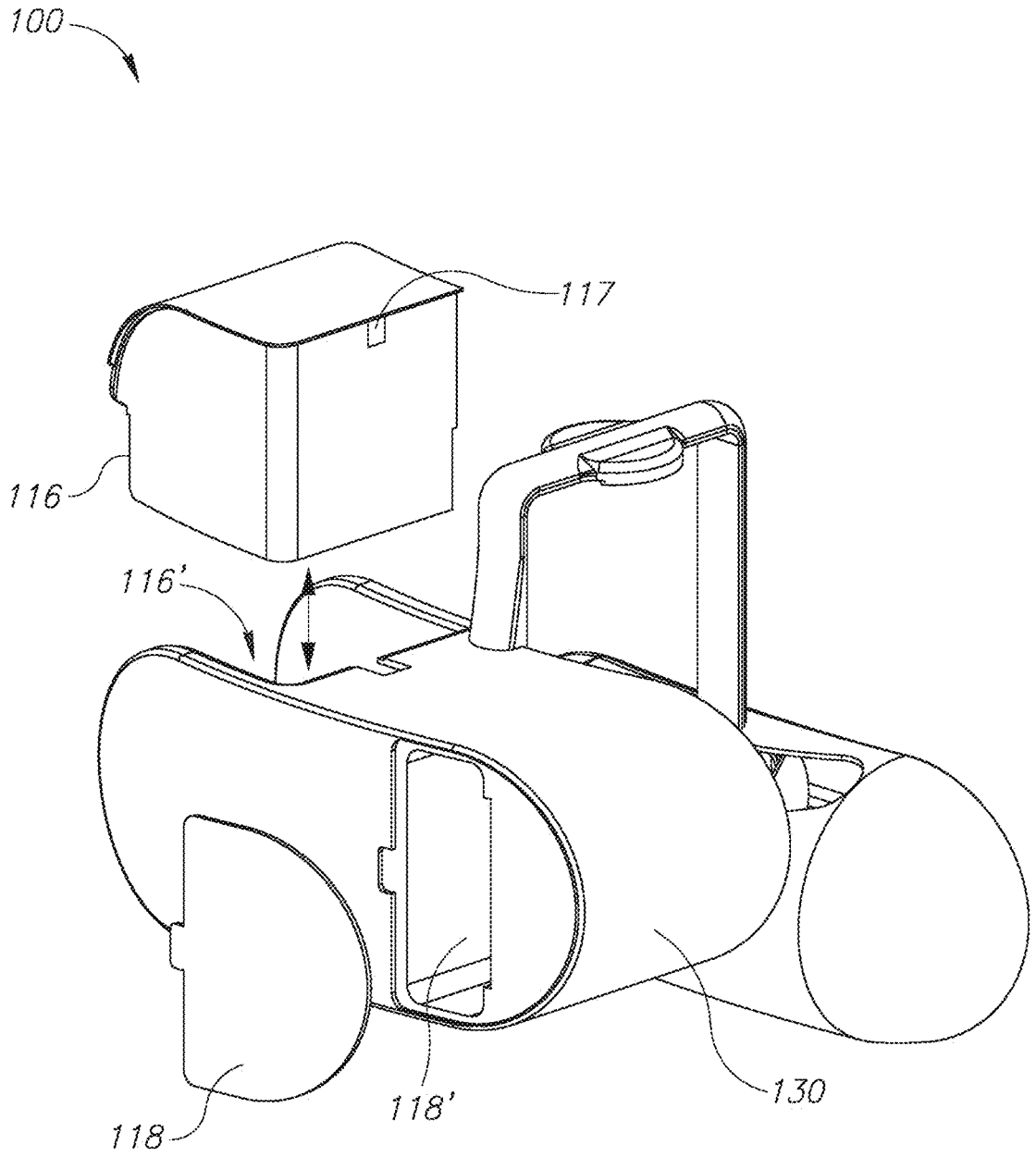
FIG. 1G shows an isometric top side view of the cleaning device 100 containers and covers, in accordance with configurations.

FIG. 1G shows an isometric top side view of the cleaning device 100 containers and covers, in accordance with embodiments. In some cases, the device units such as the batteries and cleaning containers may be easily releasable from the device and inserted back to the device. For example, the device may include a container such as an aerosol container 116 which may include a frame and audible or physical "click" type confirmation portion 117 or other units which can positively engage the container 116 to the matching cavity 116' to ensure that a suitable seal has been secured.

In some cases, the storage and control unit 130 may include a releasable cover 118 for covering for example from the side one or more batteries or other elements stored in the storage and control unit 130 such as at cavity 118'. In some cases, the cover 118 and the container 116 may include a printed sign on image explaining the type element placed within the cover of container, e.g. batteries, aerosol etc.

FIG. 2A shows a top side isometric view of the devices 100 or 150 of FIGS. 1A-1G hung on a toilet bowl rim 240 in accordance with embodiments. In some cases, the devices 100 or 150 may be suspended from the toilet rim 240 by hanging the bridge unit 120 for example along the surface of a section 225 of the toilet bowl rim 240.

According to some embodiments the device units, such as the bridge 120 are adjustable and configured to be placed or attached to any type or size of toilets.

Figure 2C:
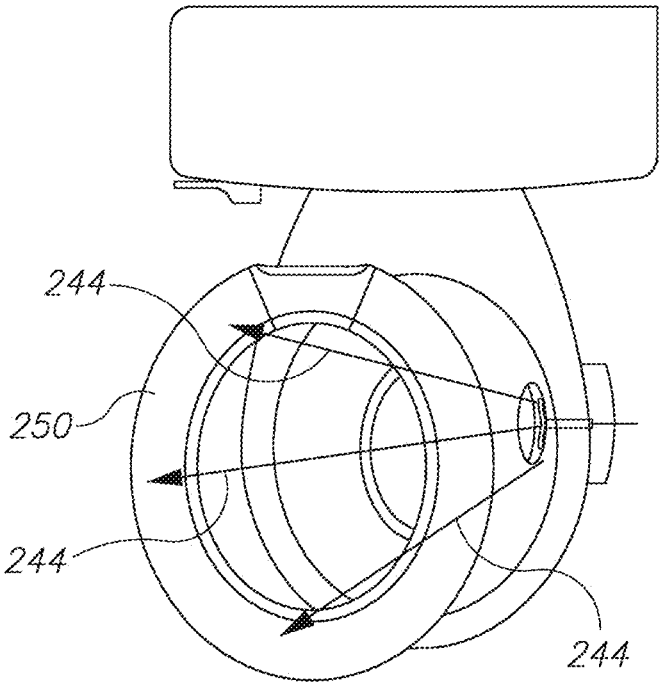

Specifically, the bridge unit 120 comprises a flat stripe section 122, preferably to accommodate the geometries of different types of toilet bowls and two flexible sections, extending from the flat stripe section, configured to be folded along the inner and external sides of the toilet bowl rim 240. For example, as shown in FIG. 1C, a first flexible section 123 extending from section 122 may be bended in perpendicular or substantially in perpendicular (e.g. between 60-90 degrees) in respect to the toilet bowl rim surface 240 downwardly towards the outer side of the toilet bowl rim surface. The first flexible section 123 may be connected to the storage and control unit 130 and hold the storage and control unit 130 in parallel or below the toilet bowl rim surface 240 as illustrated in FIGS. 2B and 2C. The bridge unit 120 further comprises a second strip section 124 extending from the other end of the flat stripe section 122 downwardly towards the interior of the toilet bowl rim. The second flexible section 124 may be connected and hold the treatment unit 110 preferably below and away the toilet bowl rim 240. As shown in FIG. 2A and further illustrated in FIGS. 5A and 5B a first portion 127 of the second strip section 124 extending from the flat stripe section 122 is bended vertically in respect to the flat section 122 while a second portion 125 extending from the first portion 127 is bended outwards in angle $\alpha$ of between 0-45 degrees in respect to axis Y from the toilet bowl rim to place the cleaning module below and away from the rim 240, for example at the path of the flushing water. Thus, water flushing on the sidewalls of the toilet bowl inner surface during flushing operation will be efficiently accumulated or to at least temporarily will retain a quantity of flushing fluids at the treatment unit 110.

In some cases, as illustrated in FIG. 2C, once the device is positioned on the toilet bowl rim, the device may be covered by the toilet's seat 250 to avoid direct contact between the device 100 and a user.

Reference is now made to FIGS. 3A-3J illustrating a number of isometric views of the treatment unit 110, in accordance with a number of different embodiments.

Figure 3A:
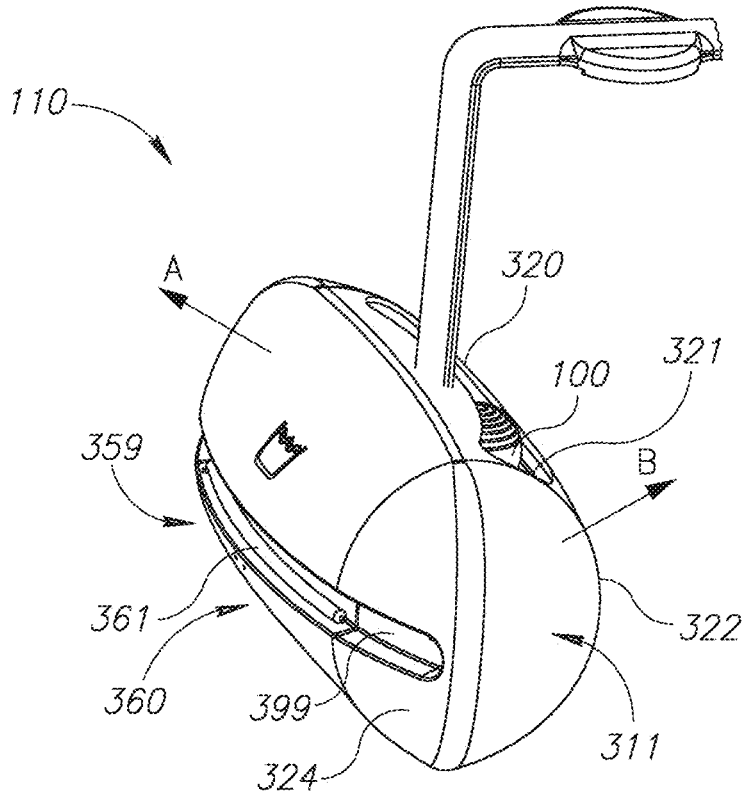
FIGS. 3A-3B show isometric views of the treatment unit, in accordance with configurations.

As illustrated in FIG. 3A, the treatment unit 110 comprises a housing 311 for covering and holding one or more fluid reservoirs such as container 321 placed within the housing. The container 321 is configured to accumulate fluids such as fresh water flushing from the toilet's flush tank via one or more openings or apertures, for example through opening 320.

According to some embodiments the opening 320 may be formed at the top right side of the housing and may have a crescent shape. In some cases, the opening width size may be between 10-30 mm for example 18 mm. In some cases, the opening may have other shapes and size.

The housing 311 may include or may be made of a number of cover parts such as two cover parts 322 and 324 which may be attached to one another according to methods as known in the art (e.g. vacuum pressure, glue, or attachment pins 384 etc.). According to some embodiments, the housing 311 is convexly shaped to enable fluid such as fresh water flushing from the toilet's flush tank to gather and flow into the opening 320 or flush down the toilets.

According to some embodiments the housing may be made of one piece having for example two convexly shaped sides A and B.

The treatment unit 110 further comprises one or more spraying units such as a first spraying unit 360 (e.g. bottom spraying unit) for dispersing cleaning composition and/or fluids such as flushing tank fluids (e.g. fluids accumulated at the container 321). The first spraying unit 360 is configured and enabled to spray the fluids typically with a cleaning composition (e.g. the detergent) all over the interior toilet bowl perimeter according to a number of predetermined intervals till a complete cleaning and sanitization of the toilet bowl is accomplished.

In this embodiment, an external arm 361 is located an elongated groove 399 forming a long narrow channel along the treatment unit 110 length, for example at the center or substantially the of the treatment unit. In some cases, the external pipe is folded and extends out of the housing 311 via opening 361.

Figure 3B:
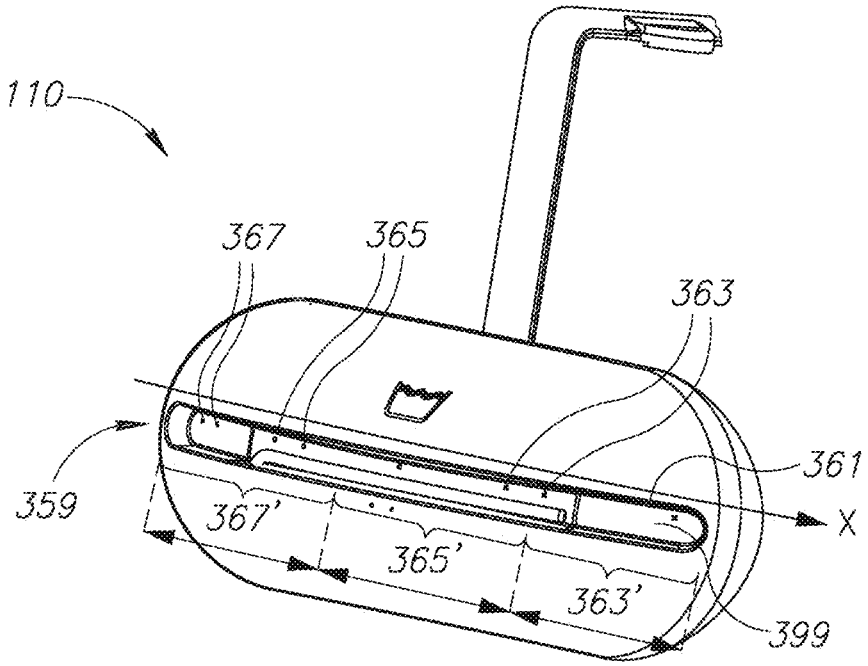
Figure 3C:
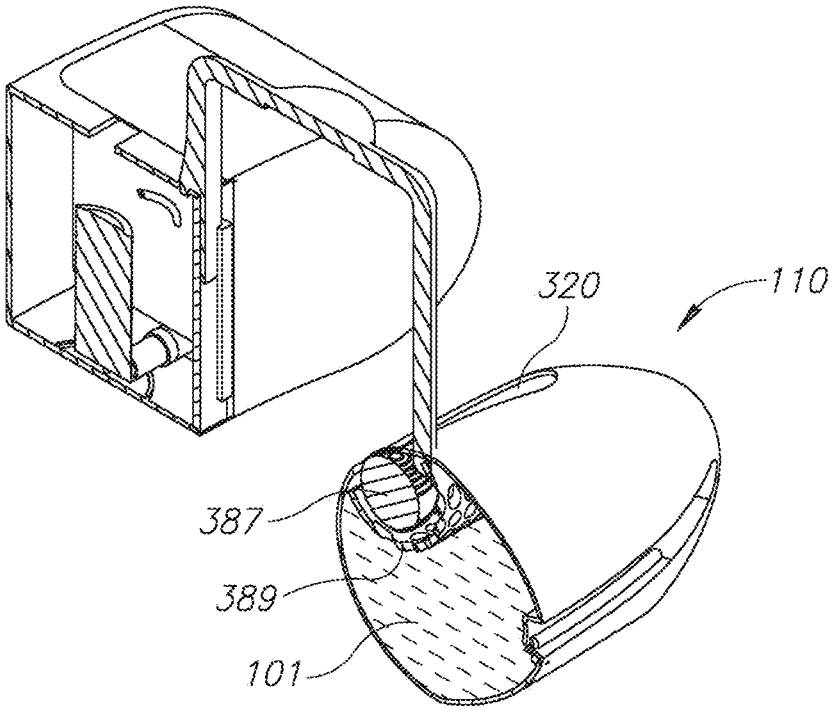
FIGS. 3C-3D show an isometric upper side cross section views of the treatment unit, in accordance with configurations.
Figure 3D:
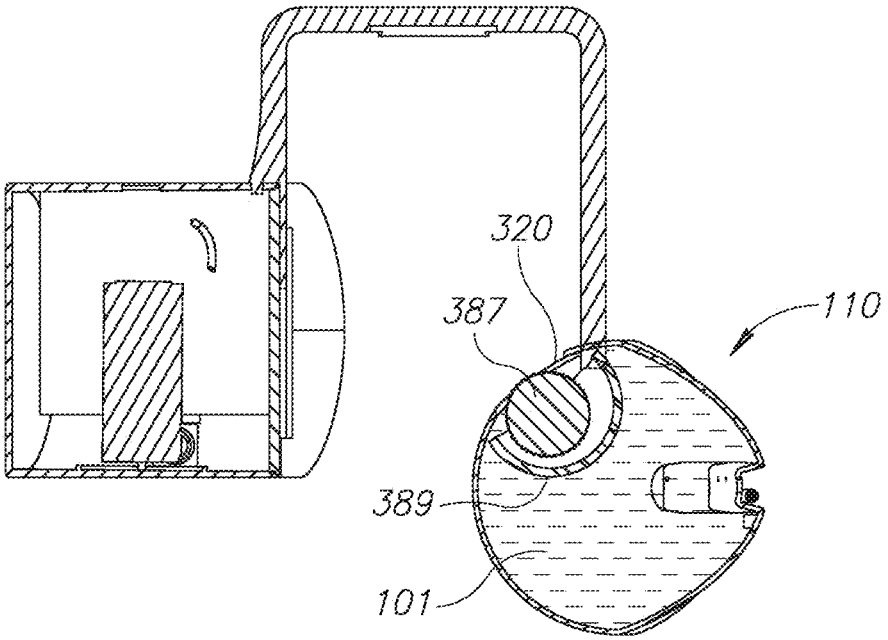
Figure 3E:
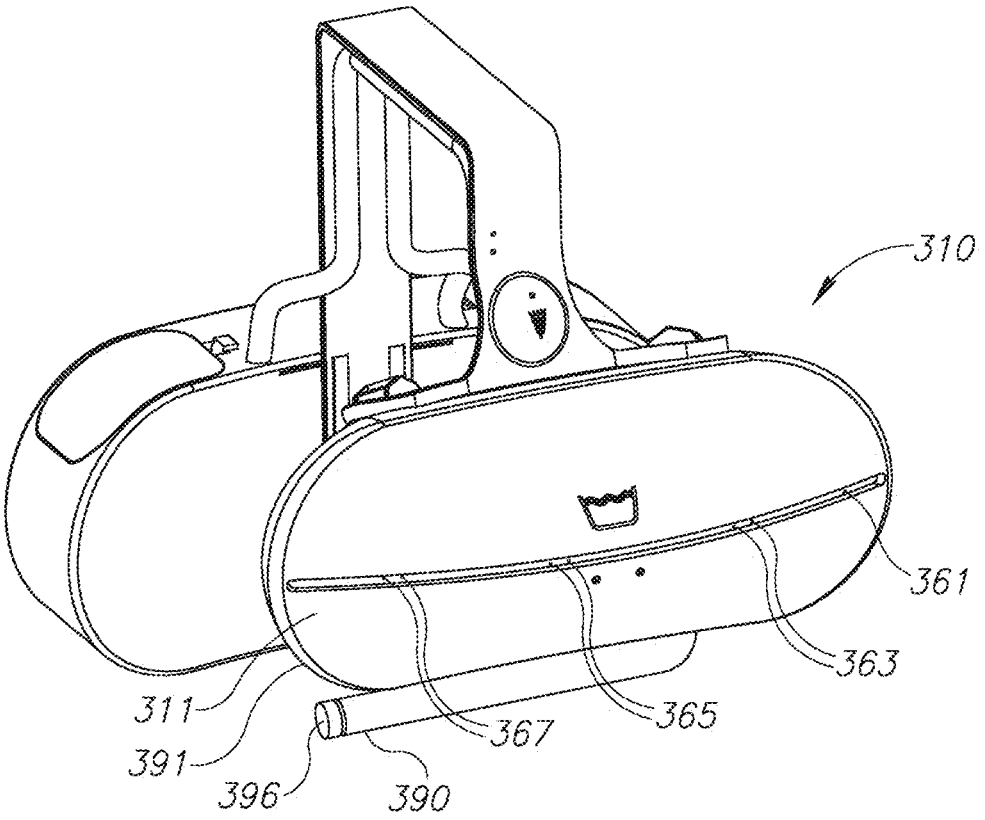
FIGS. 3E-3F show an isometric outward top and side views of the treatment unit, in accordance with configurations.
Figure 3F:
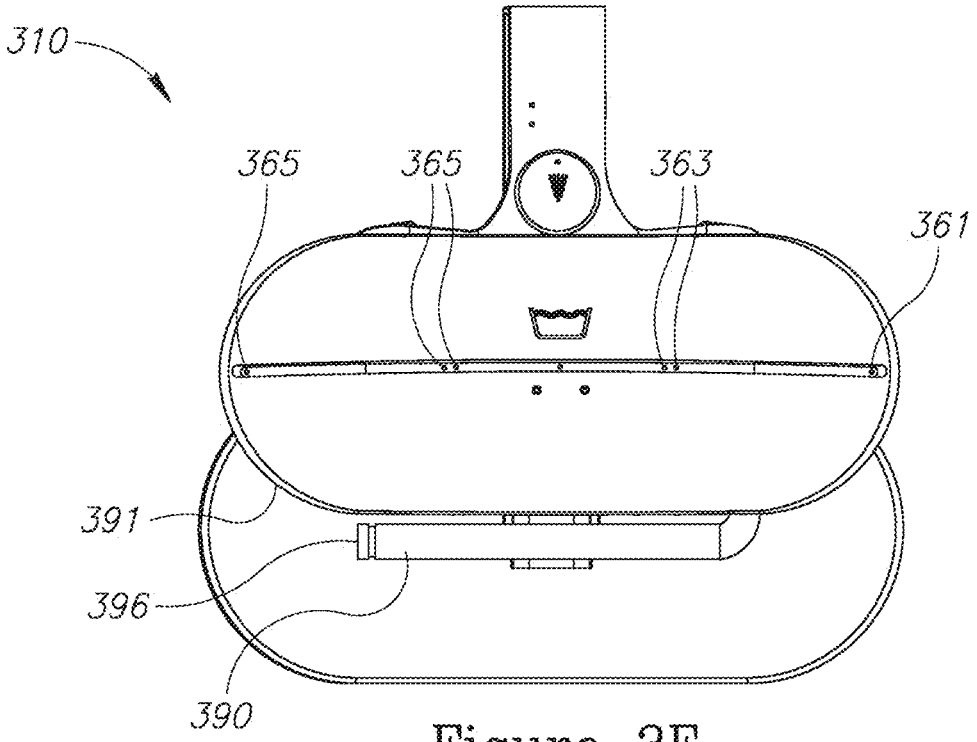

In operation, the external pipe rotates out and away from the treatment unit, in perpendicular (e.g. between 0-120 degrees) to the treatment unit length (e.g. X axis) for spreading sanitization material in 360 degrees (all directions) at the entire cavity or substantially the entire inner cavity and outer surroundings of the toilet bowl as illustrated in FIG. 3F.

According to some embodiments, the spraying unit 360 is located at an elongated groove 399 formed (e.g. notched) at the center or near the center of the treatment unit 130.

In some cases, the elongated groove 399 may be formed longitudinally at the outer surface of the housing at side A on the front side of the treatment unit facing the toilet bowl inner surface at the center of the housing around a perimeter, for example at the center, or substantially near the center of the treatment unit 110.

In some cases, the groove 399 may be shaped as rectangle along and within the housing having a depth of 1-40 mm.

For example, as illustrated in FIG. 2A a number of streams (i.e. arrows 241) are directed by the spraying unit 360 all over the interior toilet bowl perimeter to efficiently clean the toilet bowl. According to some embodiments, the elongated groove 399 includes a rail 362 notched along the housing 311 (shown also in FIG. 3G) and one or more nozzles are embedded or coupled within the rail 362 inside the housing 311. In some cases, the one or more nozzles are configured to move back and forth along the rail 362 and/or rotate while spraying cleaning composition to the toilets. In some cases, the rail 362 may be divided to a number of segments and the nozzles may be embedded along these segments. For example, as illustrated in FIG. 3B the spraying unit 360 may include a number of openings such as four openings 361, 363, 365 and 367 formed along the groove 399 for enabling a number of respective nozzles 361", 363" 365" and 367" located inside the treatment unit housing to spray cleaning materials (e.g. detergent materials) to the interior of a toilet. In some cases, the nozzles are fixed, for example to the rail 362. In some cases, the rail 362 may respectively be divided to three or more sections such as sections 363', 365' and 367' and the nozzles may move back and forth along the segments spraying for example concurrently a number of sections of the toilet bowl.

In some cases, each of the nozzles 361" 363", 365" and 367" are configured for facilitating dispersion of fluids aggregated in the housing 311 into a spray. The nozzles are used to distribute the aggregated fluids mixed for example with cleaning materials over the toilet bowl area, to increase liquid surface area, and create impact force on a solid surface.

In some cases, the nozzles may be spray nozzles such as solid-cone single-fluid nozzle, compound nozzle and other nozzles as known in the art.

According to some embodiments, the nozzles may move and rotate along the rail by one or more motors such as one or more step motors or by fluid pressure means.

In some cases, the nozzles may move and rotate autonomously without the use of dedicated motor.

In some cases, the nozzles may move or rotate by one or more means configured to move and rotate the nozzles such as one or more springs, fluid pressure means, chemical reaction, air pressure etc.

In some cases, the treatment unit 110 may include a single nozzle which is configured to move along the rail back and forth.

Figure 3G:
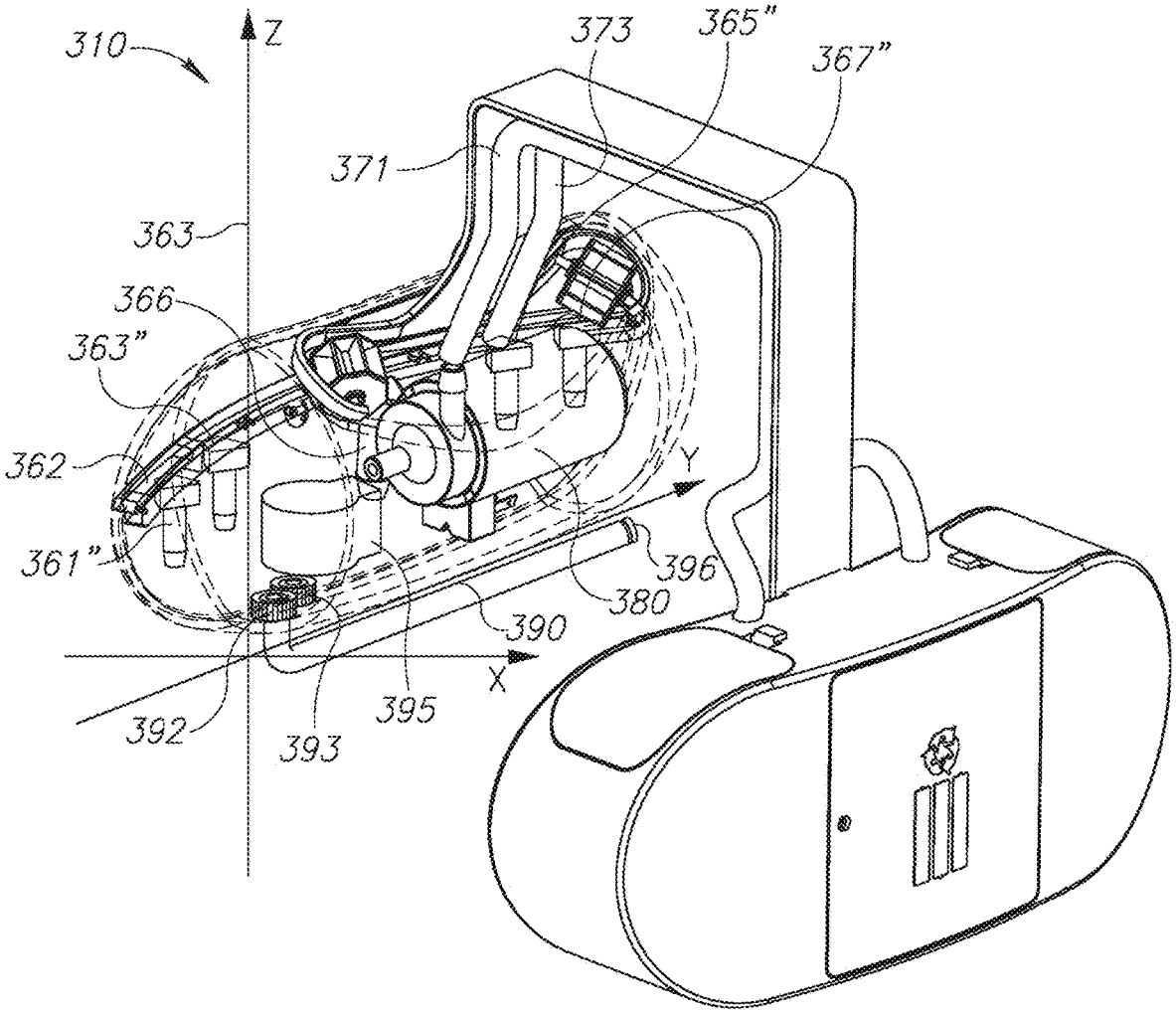
FIG. 3G shows an isometric view of the treatment unit inner units, in accordance with configurations.
Figure 3H:
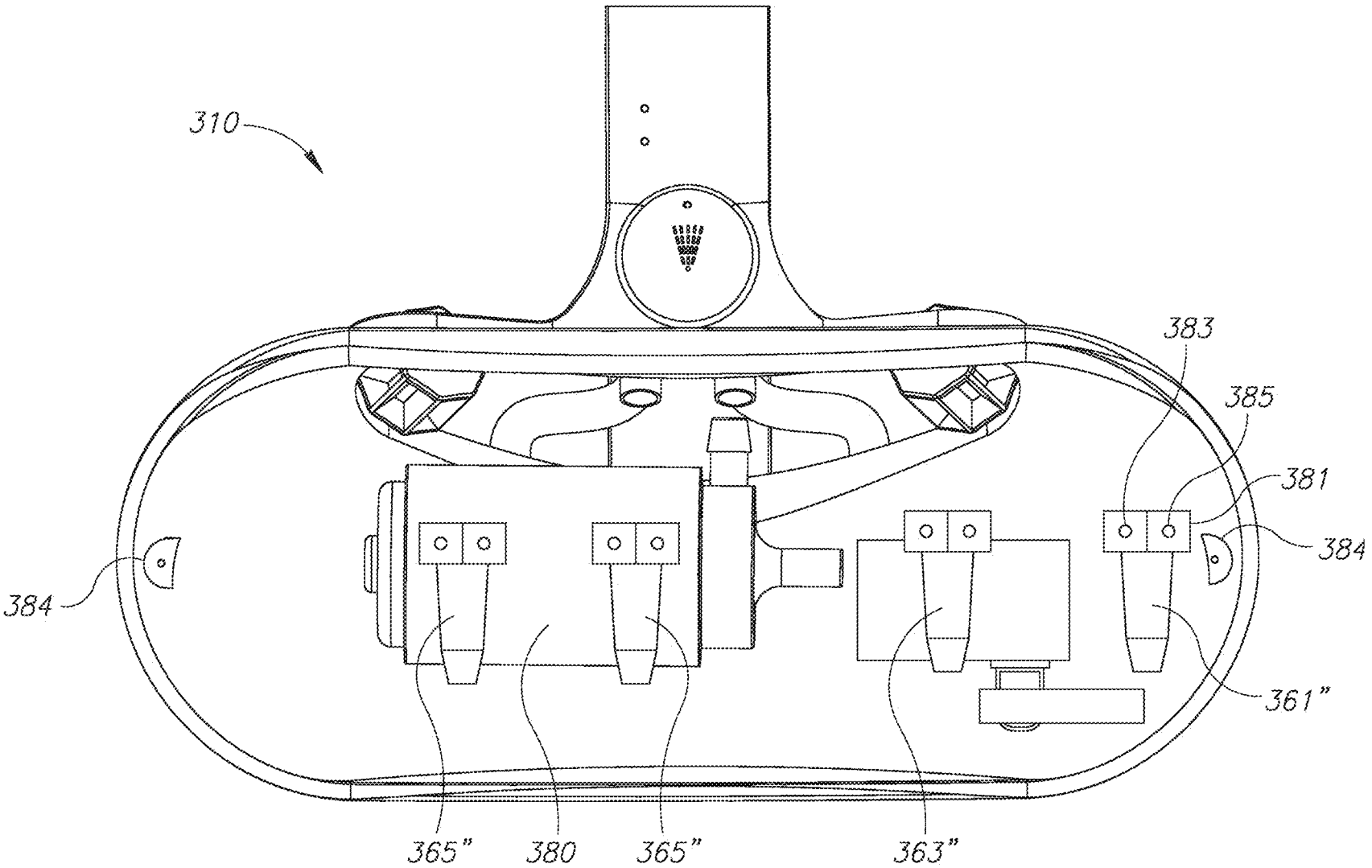
FIG. 3H shows a view of the inner units of the treatment unit, in accordance with configurations.
Figure 3I:
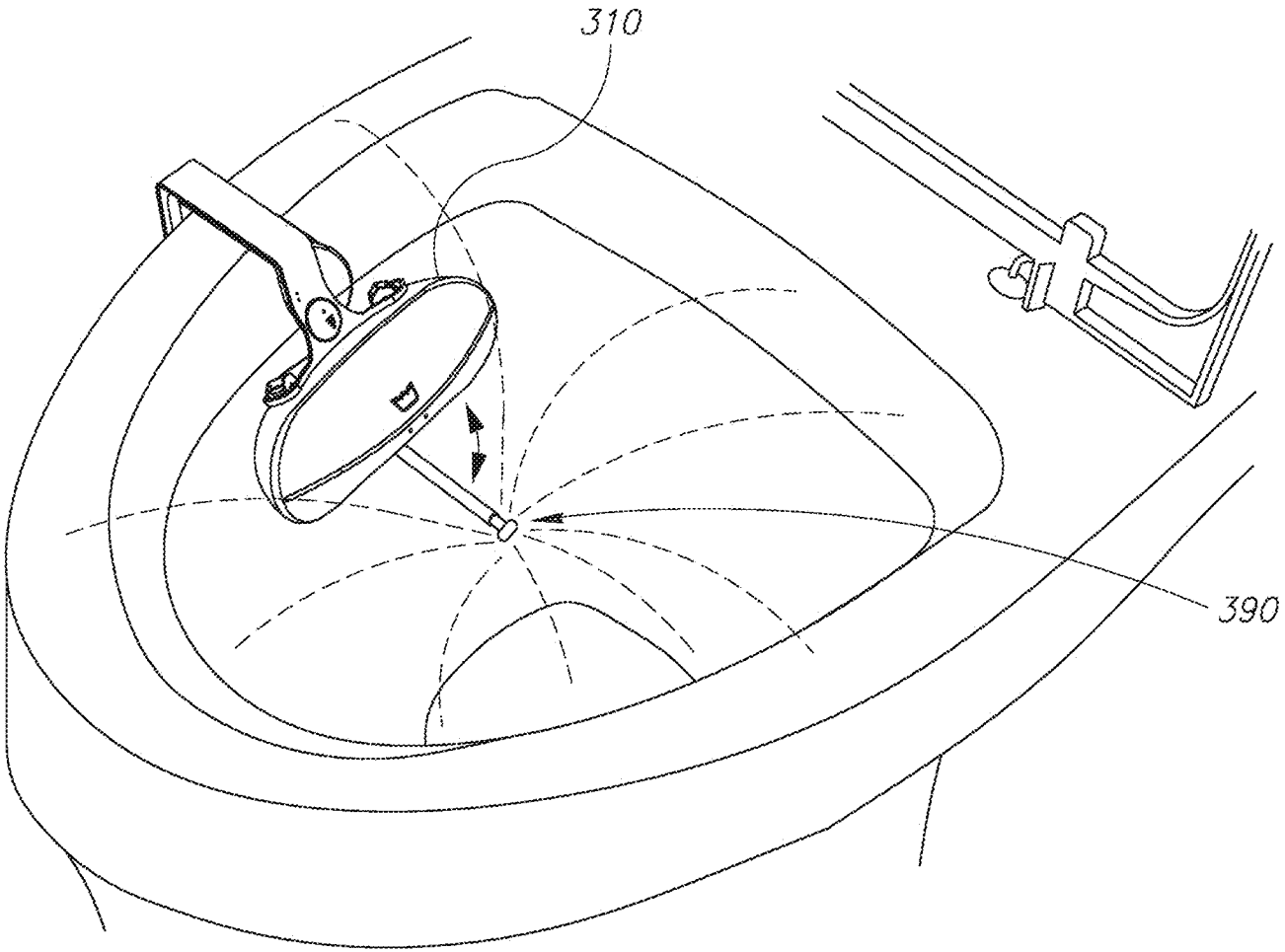
FIG. 3I shows a rotatable external arm, in accordance with configurations.

In some cases, the spraying unit may spray the accumulated fluids with or without the cleaning composition (e.g. the detergent) all over the interior toilet bowl According to some embodiments the treatment unit 110 includes an additional spraying unit 359 configured to spray cleaning materials such as sanitization and/or foaming material into the interior of a toilet bowl, for example simultaneously, in all directions (e.g. 360 degrees) as shown in FIG. 3I. The spraying unit 359 may include, for example, an elongated arm in the form of an elongated cylindrical pipe which may be placed for example in the elongated groove 399. In a pause mode the pipe is hidden within the groove. Once activated the pipe is rotated outward, for example in perpendicular to the treatment unit length axis.

According to some embodiments, the treatment unit 110 length may be between 100 mm to 200 mm for example 170 mm long and height of between 50 mm to 100 mm, for example 71 mm. The cylindrical pipe 361 may be between 50 mm to 100 mm for example 90 mm long and the groove 399 may be for example between 60 mm 190 mm long for example 160 mm long.

Reference is now made to FIGS. 3C-3D illustrating an isometric upper side view of the treatment unit 110. FIG. 3C shows an isometric cross section of the treatment unit, while FIG. 3D shows an isometric external side view of the treatment unit 110. In accordance with embodiments, the treatment unit 110 includes one or more baskets such as basket 389 for holding a solid cleaning material 387. In some cases, the basket 389 may include a plurality of holes for enabling fluids 101 flowing into the treatment unit cavity via opening 320 to be mixed and dissolve with the cleaning material 387. Specifically, in operation the fluids 101 stored at the housing cavity are mixed with the solid cleaning material 387 forming cleaning fluids which are later sprayed for cleaning the toilets (e.g. toilet bowl or toilet surrounding).

FIGS. 3E-3H illustrate a treatment unit 310, in accordance with another embodiment. Specifically, FIGS. 3E-3F illustrate respectively an isometric outward top and side views of the treatment unit 310 while FIG. 3G shows an isometric view of the treatment unit 310 inner units, and FIG. 3H shows a view of the inner units of the treatment unit 310, in accordance with other embodiments. The treatment unit 310 includes one or more pumps such as pump 380, inlet and outlet pipes such as pipes 371 and 373, one or more nozzles such as spraying nozzles 361", 363", 365", 367", one or more motors and engines such as motor 395, cogwheels 392 and 393, and an exterior spraying arm 390 and one or more sockets for holding the treatment unit 310 inner units.

According to some embodiments, the one or more pumps such as pump 380 are configured and enabled to pump (e.g. suck) fluid accumulated and stored at the housing 311 cavity via one or more inlet pipes into the pump 380 and from the pump 380 to the nozzles 361", 363", 365", 367" for spraying the pumped fluids to the toilet bowl (e.g. into the interior of a toilet) via respective openings 361, 363, 365 and 367. In some cases, the fluids include flushing tank fluids, such as fluids aggregated at the container 321 or at the treatment unit 310 cavity mixed with cleaning materials transferred via pipe 371 from the storage and control unit 130 or with cleaning materials such as solid or fluids cleaning materials placed in the treatment unit cavity.

According to some embodiments, one or more external pipes such as the external arm 390 may be attached to the bottom outer side of the treatment unit 310, for example to the outer lower surface 391 of the treatment unit 310 and connected via one or more pipes such as pipe 373 for delivering the one or more materials or compositions, such aerosol and/or disinfection agents from the storage and control unit 130 and spraying the one or more materials or compositions (e.g. aerosol and/or disinfection agents) to the toilet bowl surrounding (e.g. toilet bowl surface, seat etc.).

In some cases, the external pipe 390 may rotate up/down or to the sides along an X-Y or X-Z axis of axis X-Y-Z to efficiently clean hidden locations at the toilets or the toilets surrounding. In some cases, as illustrated in FIG. 3G, the external pipe 390 is configured to rotate between 0-180 degrees in respect to axis Y along surface X-Y using one or more cogwheels 392 and 393 coupled to the motor 395. The motor 395 is configured to rotate the cogwheels 392 and 393 which in turn rotate the external arm 390 for spraying automatically one or more materials or compositions, such as disinfection materials to the toilet bowl cavity and/or specific locations according to one or more instructions received from the processor. In some cases, the external arm 390 may be rotated to the sides/up/down (e.g. 360 degrees) in respect to the treatment unit while one or more materials such as sanitization materials are sprayed to the toilet or to the toilet surface.

In some cases, a spraying unit 396 such as a sprinkler or spray nozzle may be coupled to the distal end of the external arm 390 for spraying the sanitization material upwards (e.g.

in the Z axis direction) via one or more nozzles holes to the toilet bowl's cavity or to the toilet's surroundings.

In some cases, as illustrated in FIG. 3I the external arm 390 may be rotated and positioned perpendicular (e.g. between 60-90 degrees) to the treatment unit 310 length, wherein the distal end of the external pipe including the nozzle spray is centered at the toilet bowl cavity for generating and spreading sanitization material 360 degrees (all directions) at the entire cavity or substantially the entire inner cavity and outer surroundings of the toilet bowl.

According to some embodiments as illustrated in FIG. 3H each nozzle may include a spraying head 381 including one or more openings 383 and 385. In some cases, each nozzle may be a compound nozzle in which several individual single or two fluid nozzles are incorporated into one nozzle body. This allows design control of drop size and spray coverage angle. In accordance with other embodiments other type of nozzles may be used.

Figure 4A:
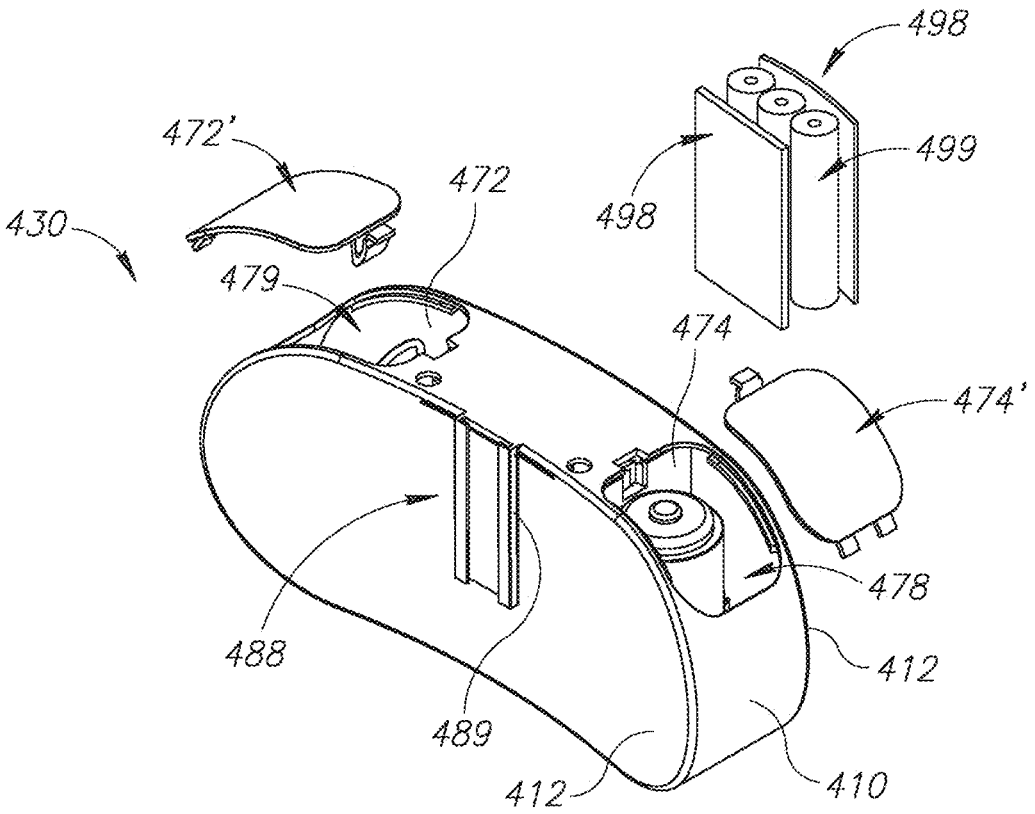
FIGS. 4A-4D show a number of isometric views of the storage and control unit, in accordance with configurations.
Figure 4B:
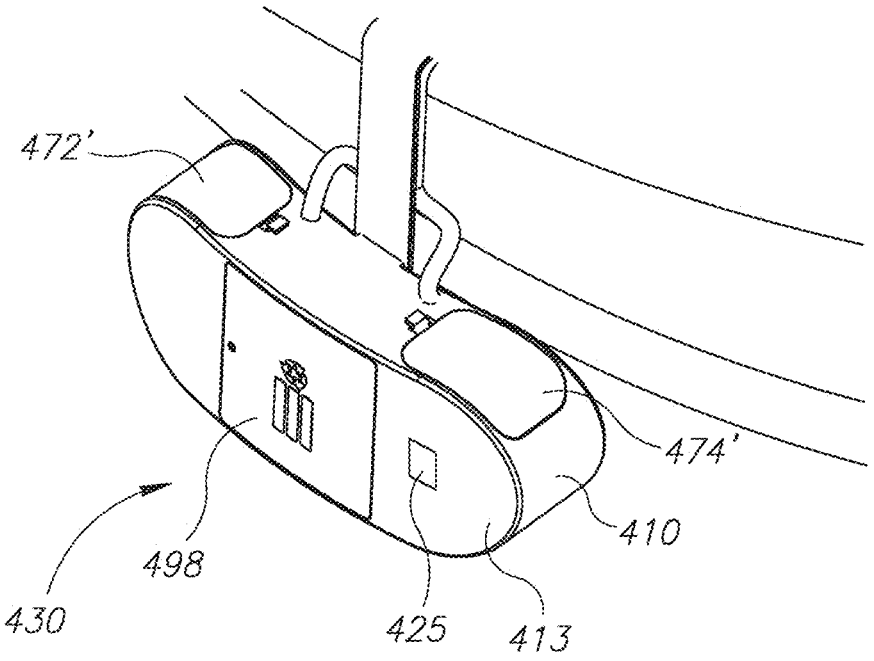

Reference is now made to FIGS. 4A and 4B illustrating an isometric top and side views of a storage and control unit 430, in accordance with embodiments. Typically, the storage and control unit 430 is externally coupled to the outer side of the toilet bowl, however many other variations and adaptations may be used for placing the storage unit 430, for example inside the toilet bowl or at other locations. The storage unit 430 comprises a housing 410 having for example a first concave side cover 412 configured to be hung in proximity to and in front of the outer side of the toilet bowl and a second compatible side cover 413 which may be convexly shaped. The housing 410 comprises a cavity including for example one or more containers which may be refilled automatically or manually with cleaning and disinfection materials in the form of liquid or powder or solid materials for cleaning and/or foaming and/or disinfecting the toilets.

For example, according to some embodiments, at the top or sides of the housing there are included one or more refill openings which may be sealable by one or more covers to seal the one or more inner containers. For example, the housing 410 may include two sealable openings 472 and 474 located at the top sides of the storage unit 430 and may be covered by matching covers 472' and 474' which may be used to seal containers 478 and 479, for example by one or more clicking means.

In some cases, the device units, such as the containers 478 and 479 may be easily releasable from the device and inserted back to the device. For example, the containers 478 and 479 may include a frame or other units which can positively engage the body and/or frame to ensure that a suitable seal has been secured and may provide an audible or physical "click" type confirmation.

According to some embodiments, the device comprises one or more power buttons or switches, such as button 425 installed at the storage and control unit 430, shaped for example as a round or square button configured to power the device 100 on and off. Typically, the device powers on when the button is pressed and powers off when the button is pressed again. In some cases, the device may include one or more sensors including voice recognition means for identifying a user command for activating the device on or off. In some cases, the one or more buttons may be positioned on or connected to other units such as the bridge 120 and/or the treatment unit 110.

Figure 4C:
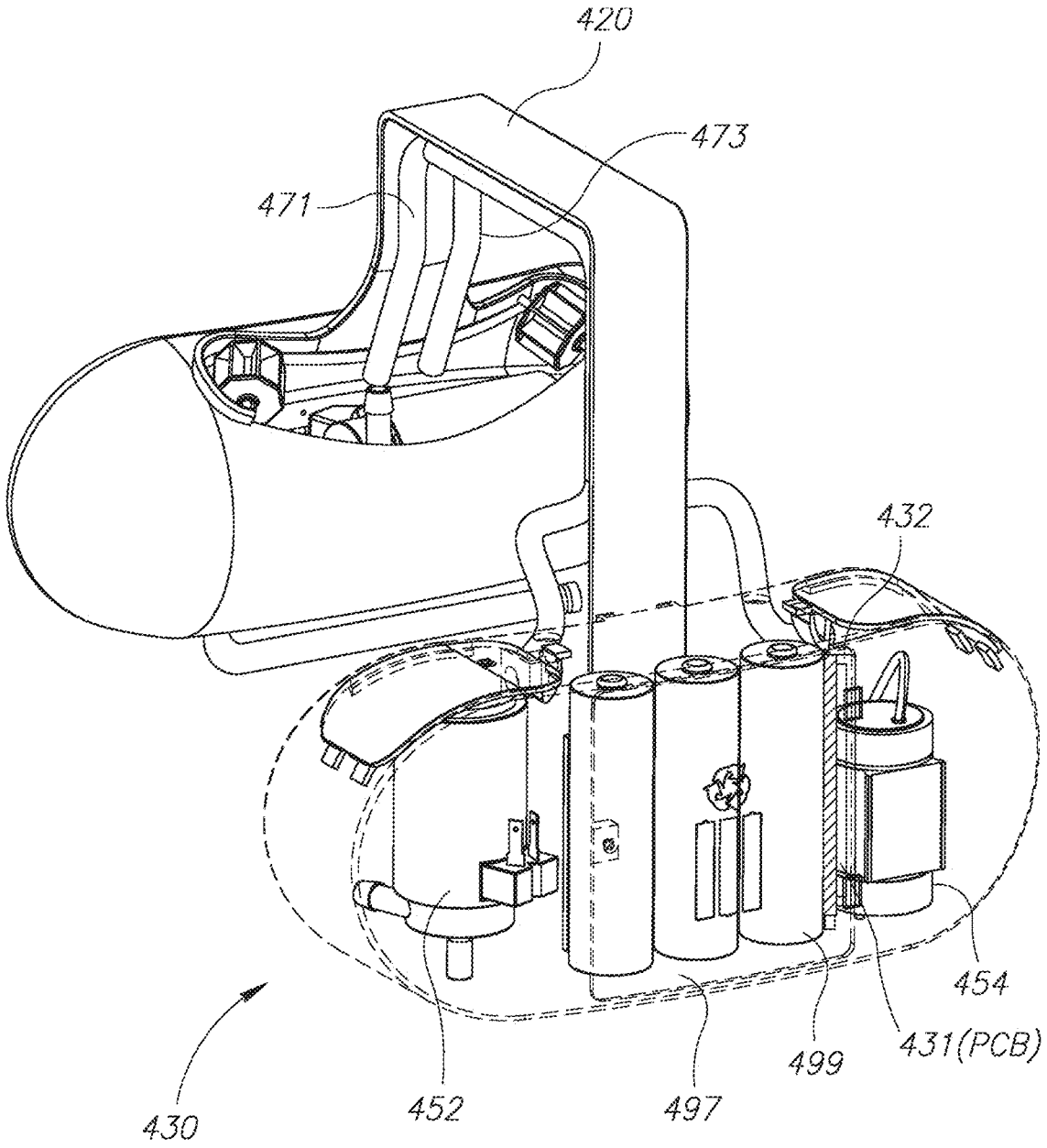

FIG. 4C shows an isometric view of the units located inside the storage unit 330, in accordance with embodiments. The storage and control unit 430 comprises one or more pumps, such as a first and second pumps 452 and 454, and a circuit board 432 such as a PCB including one or more processing units such as processing unit 431 and memory units 433 and a power source 499. In some cases, the storage and control unit 330 includes a single pipe.

The processing unit 431 is configured to control the device unit for automatically and autonomously cleaning toilets without any human intervention. In operation, the processing unit receives data from the device units including for example one or more indications received from the device units such as the device's one or more sensors and process the data to yield output data for accordingly controlling the device units.

In some cases, the processing unit 431 is configured and enabled to receive movement or pressure indication from said sensors and operate the device spraying units to spray fluids on the interior surface of a toilet bowl according to said sensors indications.

In some cases, the processing device may receive indication of low cleaning material at the cleaning containers or at the cartridges and accordingly update the user to refill the containers or cartridge. In some cases, the processing unit may provide warnings or indications in the form of a "low material" "low cartridge" status indicator light, or a series of flashing lights that require a user to consult the manual to decipher them.

In some cases, the processing unit may launch a pop-up notification to a user computer screen or mobile device when cleaning toner levels are low.

In some cases, the device comprises a communication module configured to communicate to a server and other units such as speakers to provide information on the unit device status.

In some cases, the communication module is configured to transmit the collected data to a cloud-based server which is configured to analyze the data transmitted from the communication device, and a device configured to receive analysis results from the cloud-based server and present the analysis results to a user.

In some cases, the information includes the amount of cleaning materials in the device's containers; power level (e.g. low, high).

In some cases, the processing unit may automatically and/or autonomously send instruction, for example by the communication module to refill the containers or to recharge the device.

The pumps, such as pumps 452 and 454 are configured to deliver respectively a cleaning and/or sterilization composition of a first type and a cleaning and/or sterilization composition of a second type. For example, the cleaning or sterilization composition of the first type may be of perfuming composition, water coloring composition, non-stick composition, bleaching composition, foam generation composition, good filings and euphoria composition, pheromones, caustic composition and the composition of the second type may be or may include an alcohol composition for toilet's sanitization. The storage unit 430 further comprises a case 497 comprising the one or more batteries 499.

In operation, the openings are refilled with cleaning chemicals or liquids which are further transmitted by transferring means such as pipes and/or pumps (e.g. pumps 452 and 454 and pipes 471 and 473) via the bridge unit 420 into the treatment unit which sprays the appropriate chemistry or cleaning fluids to the inner surface of the toilet bowl or to the toilet's surroundings (toilet seat) to conduct the cleaning process.

In some cases, the cleaning materials (e.g. disinfection material) may be included in one or more dedicated refill cartridges which are configured to be positioned into the device containers, such as container 453 at the storage and control unit 430. The cartridge may be detachably mountable for example to fixed contained within the storage and control unit.

Figure 4D:
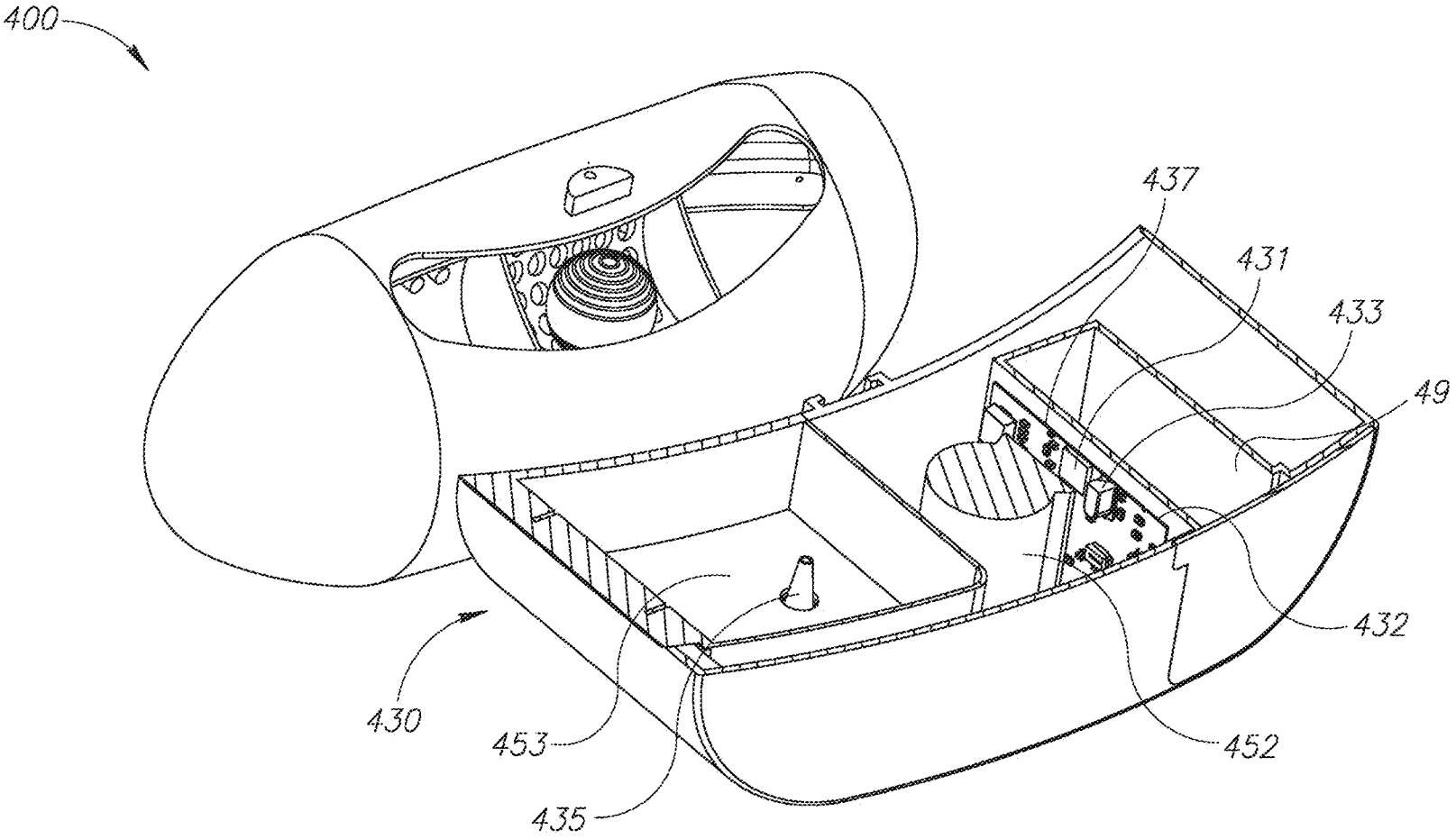

In some cases, the cartridges include one or more opening sealed for example by a sealing portion made of for example nylon. As illustrated in FIG. 4D, once the cartage is attached to the dedicated container 453, one or more pins such as pin 435 creates a hole at the cartridge and the cleaning material is pressed out of the cartridge and flows to the device's pumps via one or more pipes, and further to the sparing units such as the nozzles and/or spraying arm for spraying the cleaning material to the toilets bowl cavity.

In some cases, the cleaning composition may be or may include chemicals materials configured and enabled to prevent infection. The composition may further include one or more of perfuming composition, water coloring composition, non-stick composition, bleaching composition, foam generation composition, good filings and euphoria composition, pheromones, caustic composition. The compositions may be in the form of one of: jell, tablets, liquid, powder or any other shape of materials as known in the art.

In some cases, the device may include materials and/units for controlling the amount, color, intensity of the perfume or foam composition.

For example, the device may schedule according to predetermined intervals (e.g. by the processor unit 431) the injection of the chemical materials as part of the toilet's treatment process. A treatment program may include for example a treatment schedule according to the following order:

a. softener material b. disinfections material c. whiting material d. anti-stick materials e. perfume materials f. coloring materials g. foamy materials.

The treatment schedule may be in a different order or may include additional materials.

According to some embodiments, the chemical material composition is configured to provide a coloring reaction.

In some cases, the treatment chemical material is configured to slowly decompose, by using specific chemical materials controlling the chemical reaction.

In many embodiments, the device also includes a power source (e.g. one or more batteries 499) and one or more power source covers 498. In some embodiments, the device 100 is powered by a power supply from an external source. In some embodiments, the device 100 has an independent power supply.

In some embodiments, the batteries 499 may be placed within the storage unit 130. For example, as shown in FIG. 4A the external cover 413 may include one or more movable battery covers 498 which can be swung away or alternately may be replaceably removed with respect to the housing in order to provide access for a user to insert one or more batteries 499. The one or more batteries 499 may be one or more single use batteries or may be rechargeable batteries which provide a power supply to operate the treatment unit 100.

In some embodiments, the storage and control unit 430 may be connected to the bridge unit 120 by connecting means such a holder 488 comprising a connection sleeve 489 configured to receive a portion of the bridge unit. Although FIG. 4A shows a method performed by sliding a portion of the bridge 120 into a bridge holder 488, a person of ordinary skill in the art will recognize many other variations and adaptations for connecting the device 100 units to one another.

According to some embodiments, the containers of the storage and control unit, such as container 453 may have a volume of between 100-800 ml, for example 400 ml.

In some cases, the length of the of the storage and control unit 430 may be between 100-200 mm, for example 170 mm, the height between 50-150 mm for example 94 mm and the width between 30 mm to 100 mm, for example 65 mm.

In some cases, the storage and control unit 430 may include a container or housing F for holding the power source 499.

Figure 5A:
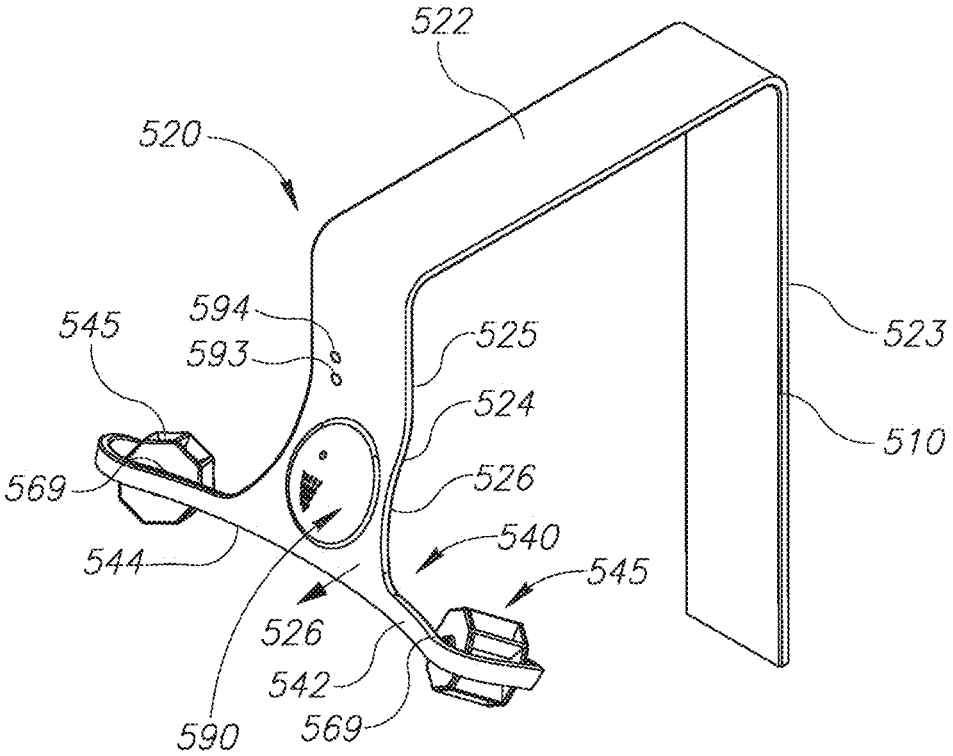
FIGS. 5A and 5B show an upper side isometric views of the bridge unit, in accordance with configurations.
Figure 5B:
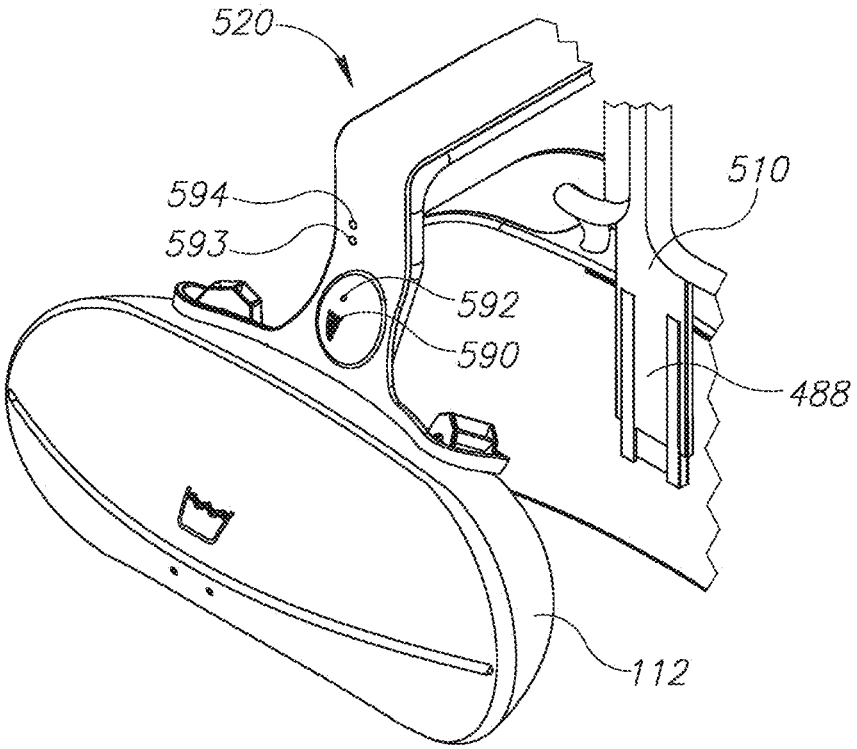

Reference is now made to FIGS. 5A and 5B illustrating isometric upper side views of a bridge unit 520, in accordance with embodiments. The bridge unit 520, in some cases, is shaped as an elongated flexible strip which may be hung along the surface of a section 225 of the toilet bowl rim 240 and hold the treatment unit 110 and storage and control unit 130, of device 100 or device 150 or other cleaning devices illustrated herein for example at the sides and below the toilet bowl rim 240. The bridge unit 520 comprises one or more pipes (e.g. pipes 473 and 471) attached for example to the bridge unit 520 surface for delivering and supplying cleaning materials (e.g. aerosol and other agents) and/or fluids to the spraying units such as the first sparing unit 360 and/or external arm 390.

In some cases, the pipes may be made of plastic or other materials as known in the art.

Alternatively or in addition to the pipes, the device 100 may include one or more channels or pipes formed internally as part of the device inner units for supplying treatment materials and/or fluids to the spraying unit 360 or 390. In some cases, the materials may be delivered by air pressure means.

Specifically, the bridge 520 comprises a flat stripe section 522, preferably configured to accommodate the geometries of different types of toilet bowls, and two flexible sections extending from both ends of the flat stripe sections configured to be folded along the inner and external sides of the toilet bowl rim 240. For example, a first flexible section 523 extending from section 522 may be bended in perpendicular or substantially in perpendicular (e.g. between 60-90 degrees) in respect to the toilet bowl rim surface downwardly towards the outer side of the toilet bowl.

According to some embodiments, the distal end 510 of the first flexible section 523 is configured and enabled to slide into the bridge holder 488 and hold the storage unit 130 at the external side and below the toilet bowl rim. It is noted that other methods and configurations may be used to connect the bridge unit 520 to the external and/or the treatment unit.

The bridge unit 520 further comprises a second curved section 524 extending from the distal end of the flat stripe section 522 downwardly towards the interior of the toilet bowl. The second section 524 is configured and enabled to be connected to the treatment module and hold the treatment module below the toilet bowl rim 240.

According to some configurations, the bridge unit 520 may include a second spraying unit 590 (e.g. upper spraying unit) such as an aerosol unit for cleaning and disinfecting the toilet bowl. The second spraying unit 590 may comprise one or more spraying devices such as nozzles, such as nozzle 592 connected via one or more pipes to the storage unit 130 and configured and enabled to spray aerosol into the bowl interior surface.

In some embodiments, the second spraying unit 590 may be positioned at the distal end of the second curved section 524 so as to enable direct spraying to the upper surface of the toilet bowl, for example to the toilet bowl areas which may not be sprayed by nozzles 363, 366 and 369. As illustrated in FIGS. 2B and 2C the second spraying unit is configured and enabled to spray cleaning materials (such as streams 244) and/or disinfection material via a plurality of nozzle on a toilet seat 250 or toilet space.

In some cases, the bridge unit 520 may include one or more indicator units, such as indicator unit positioned at the outer surface of the upper portion 525. The indicator unit may include one or more lights such as LEDs 593, 594 indicating the status of the system (e.g. on or off) or which unit (e.g. upper or lower spraying units) is currently activated.

Figure 5C:
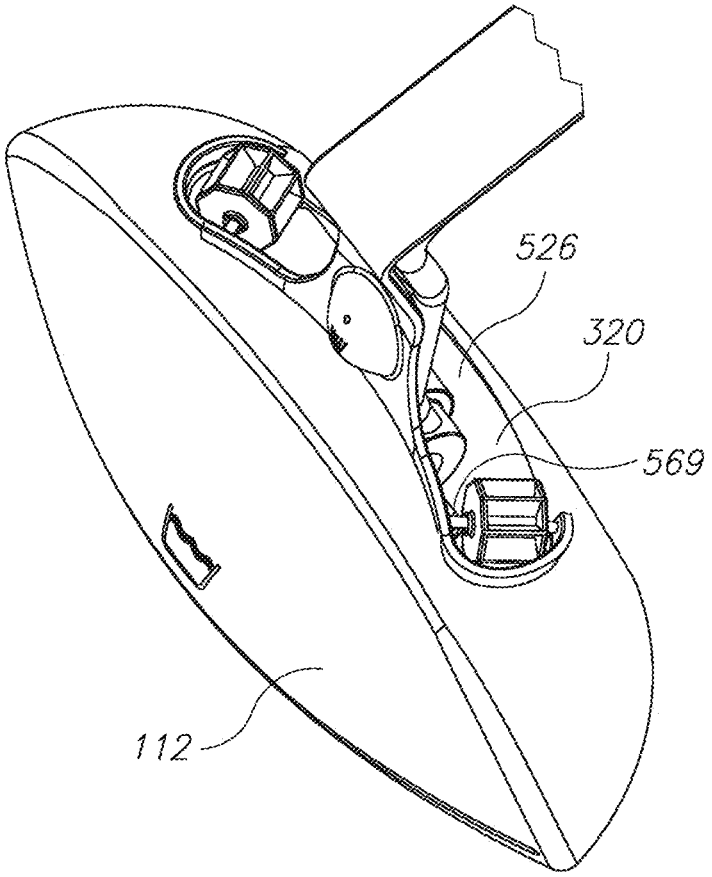
FIG. 5C shows an upper isometric view of the rotating wheels inside the treatment unit, in accordance with configurations.

According to some embodiments, the bridge unit 520 comprises or is connected to electrical generator means, for example, a hydropower unit 540 for producing hydroelectricity to, for example, charge the device's power source, e.g. batteries 499 and thus provide power to activate the device's electronic units for example LEDs 593, 594. The hydropower unit 540 comprises one or more rotating coils of wire such as water wheels to convert mechanical rotation into a pulsing electric current. For example, according to some configurations, the second strip section 524 comprises a 'T' shaped portion 526 curving away between 30-60 degrees in respect to the upper portion 525 of the bridge. The 'T' shaped portion 526 comprises two arms 542 and 544 extending to the sides from the second strip section 524 and configured to hold one or more electrical generator wheels, such as wheels 545 using respectively pins 569. According to one configuration, as illustrated in FIG. 5C, portion 526 may be attached to the sides of opening 320 of the treatment unit 112 and the wheels 545 may partially or completely be inserted into the treatment unit 112 cavity.

Figure 5D:
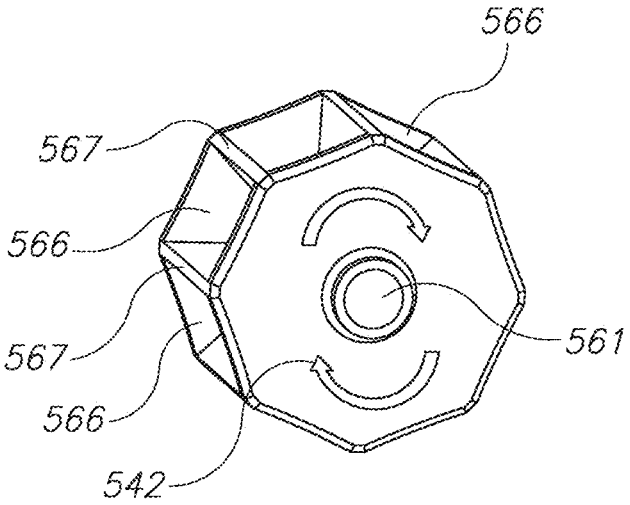
FIG. 5D shows an upper isometric view of the rotating wheel, in accordance with configurations.

FIG. 5D shows a side view of the water wheel 545, in accordance with embodiments. The water wheel 545 may be octagonally shaped comprising a pivot 561, a number of cavities 566 and blades 567 which are mounted around the circumferential rim of the wheel to prevent the escape of fluids from the ends of the cavities 566 until they have moved a certain distance.

In operation, toilet's flushing fluids are directed via the opening 320 of the treatment unit 112 to the blades of the water wheels, creating a force on the blades. In this way, energy is transferred from the water flow to the wheels (e.g. turbine) producing hydroelectricity in the way water turbine (e.g. Pelton wheel) is operated.

Alternatively or in combination, the wheels, such as wheels 545 may be used as a meter such as a measurement unit for measuring the toilet flush water speed or status (e.g. flushing time) for indicating if the toilet use was completed and the type of use according to the flushing duration. The indications such as the toilet flushing speed and time may be transmitted to the one or more processing unit for activating accordingly the suitable cleaning process. For example, an indication of a short use of the toilets may activate a first cleaning process by for example the cleaning unit 360 for a short period, while an indication of a long use of the toilets (e.g. as a result of indication of flushing for a long period) will automatically activate the rotatable cleaning arm for sanitizing the toilets and/or the cleaning unit for a longer time.

Alternatively or in combination, the device may include other energy generators and motors by way of non-limiting examples these include one or more of: a stepping motor, air pressure means, spring pressure means, chemical reaction mans, mechanical or electrical pressure amplifiers rotary motor or any motor which is configured to activate the system cleaning units such as the system's nozzles or sensors.

According to some embodiment, the bridge unit 520 dimensions may be between 50-130 mm long such as 100 mm at the center section (i.e. the flat stripe section 522) and may extend between 50-100 mm, for example 90 mm at one side (i.e. the second section 524) and between 50-100 mm, for example 60 mm at the other extending section (i.e. section 523). In some cases, the bridge width (i.e. section 522) is around 30-50 mm for example 40 mm.

Figure 6A:
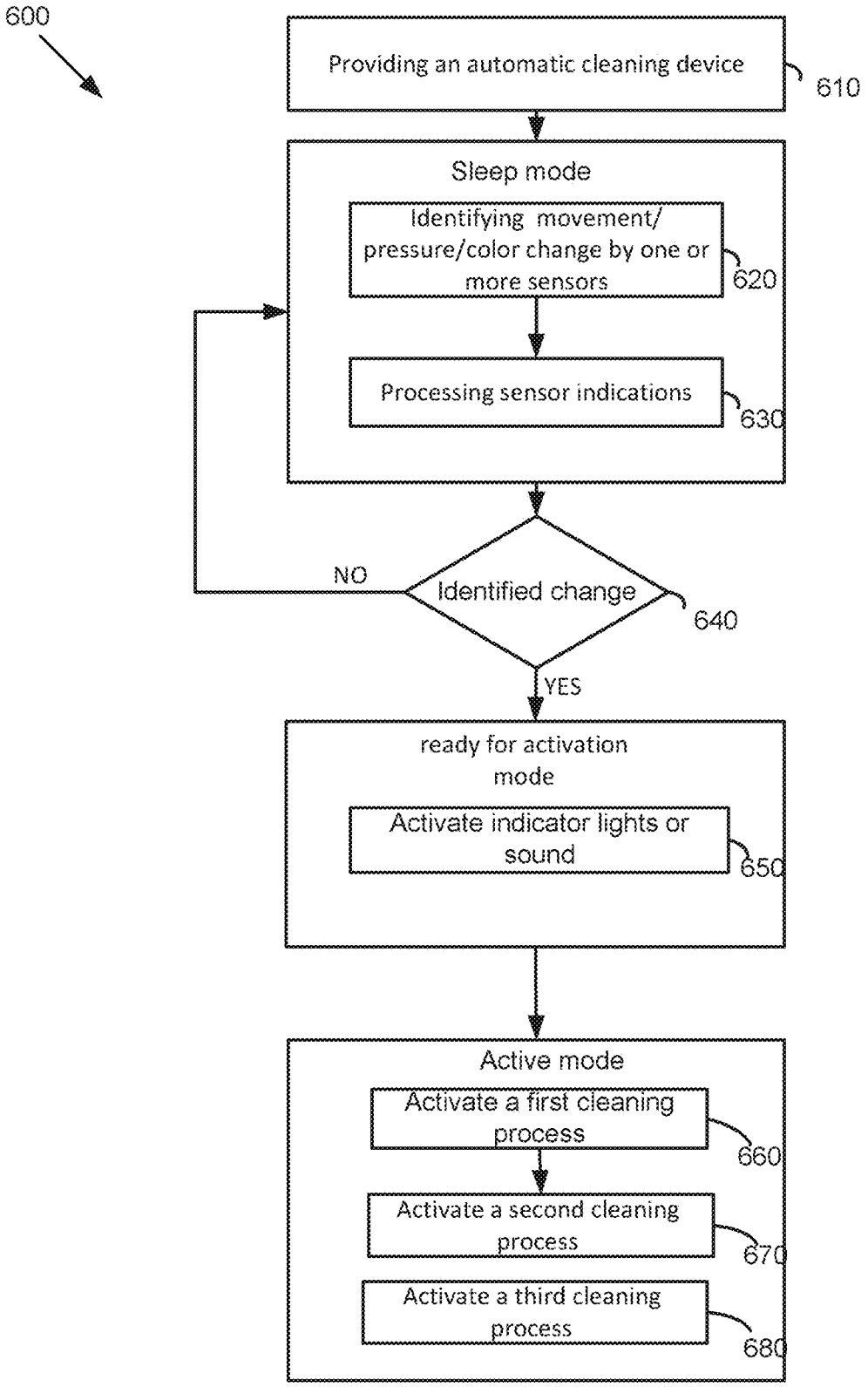
FIGS. 6A-6B shows a flowchart of a method for cleaning and/or foaming and/or disinfecting a toilet, in accordance with configurations.

Reference is now made to FIG. 6 illustrating a flowchart of a method 600 for automatically and/or autonomously cleaning and/or foaming and/or disinfecting toilets, in accordance with embodiments. At step 610 a treatment device such as the toilet cleaning device illustrated in FIGS. 1-5 is provided and initially installed upon a lavatory appliance, i.e. on the toilet's rim. Typically, the device's initial state or 'default' state is 'sleep mode' where the device is inactivated or in a low power mode. In some cases, for indicating the specific state of the device one or more control lights may be operated, for example one or more lights may light the inner surface of the toilet bowl to indicate the device's mode, for example according to the lights color (e.g. green—'active', red—'inactive'). At step 620, one or more toilet use indications are identified such as movement and/or pressure and/or toilet's color change and/or toilet seat movement and/or voice of one or more users. According to some embodiments, the indications are monitored and identified by one or more sensors, for example by an electronic pressure sensor or distance sensor or by a biologic sensor (e.g. PH sensors), or be a pressure detection sensor such as sensor 119 embedded at the bridge unit 120 for identifying and sensing a pressure or movement of a user such as user seating on the toilet seat or by other types of sensors such as the sensors discussed herein above or other sensors as known in the art. The sensors are configured to identify the specific toilet use and accordingly provide data (e.g. which includes one or more indications) to the processor unit (e.g. processor unit 431) which activate the treatment device 100 based on the received data.

At step 630 the data (e.g. specific indication such as movement, pressure or color, toilet seat movement) is analyzed by the processing unit and thereafter according to the processing output the device state transforms to a 'ready for activation' state or back to 'sleep mode'. At the following conditional step 640 if affirmative, and it is determined by the one or more processing units (which are configured to specifically identify the type of toilet's use based on the sensors indication) that a cleaning process is required then the device transforms to 'activation' mode. If an indication was not found, the device mode transforms back to a sleep mode. In some cases, one or more indication lights are switched on to an activation light (e.g. green) and/or a voice hazard is activated according to the identified indication. For example, yellow colored indication for the first cleaning procedure (as illustrated at step 660) and a green color for the second procedure (as illustrated at step 670). At step 650, the device is activated and a cleaning procedure is initiated based on the processed data.

The cleaning process includes, according to some embodiments, the following steps: At step 660 the bottom spraying unit 360 is activated and one or more sparing means such as nozzles 361", 363", 365" and 367" automatically spray fluids such as fluids which were accumulated and/or stored for example at a container 321 mixed with one or more treatment materials/cleaning agents which were stored at the treatment device (e.g. solid material 387). The spraying may include using pump means such as pump 380. An example of such a spraying procedure is illustrated in FIG. 2A.

In some cases, the one or more nozzles such as nozzle 361", 363", 365" and 367" automatically move and/or rotate along rail 362 spraying fluid which were stored for example at a container 321 along with one or more treatment materials/cleaning agents which were stored at the treatment device.

According to some embodiments, the treatment materials/cleaning agents may include the following materials sprayed in the following order: a. cleaning and whiting materials b. anti-stick materials c. foamy materials d. coloring materials e. perfuming materials. It is noted that the cleaning procedure may include a use of other materials according to a different order.

The treatment materials may include for example one or more of chlorine, etheric oils, coloring materials, sanitizations materials which include for example clean alcohol or other sanitizations materials, for anti-stick materials a silicon or Teflon materials may be used.

In some cases, the treatment materials are sprayed by water pressure means via the nozzles by water flash which may be reserved for example at the treatment unit container.

In some cases, the cleaning process may last for predetermined time interval of for example 1,2,3,4,5,6,7,8,9,10, 11,12,13,14,15,16,17,18,19 or 20 or more seconds.

In some cases, the cleaning process may be repeated according to a cleaning matrix, which includes a cleaning procedure as illustrated herein above.

According to some embodiments, the cleaning matrix may be activated according to information or data indications received from the processing unit. The information may comprise images of the toilet or toilet room or toilet area (e.g. toilet bowl or toilet surroundings) or mapping of the toilet area. The processing steps may include a comparison of one or more images of the toilet place (e.g. before and after the toilet use) or comparison of the toilet image to an image reference such as a white color image or other color reference.

In some cases, the matrix may comprise dividing the toilet to a number of sections represented by the cleaning matrix and the processing steps may include identifying one or more specific sections of the matrix sections which require additional or specific treatment according to the identified status of the section. For example, the lower inner part of the toilet bowl may be a first section and the surface around the toilet may be a second section. Once processed (e.g. based on image processing, or RF data, radar data) the cleaning matrix may include data including which type of cleaning is needed for each section.

Specifically, as illustrated in FIG. 2C the toilet, e.g. the interior surface and/or the toilet surrounding may be divided to a virtual cleaning matrix having lengthwise and crosswise lines (x, y, z . . . and 1,2,3 . . . ) where each formed rectangle frame defines a section. An image of the interior surface of a toilet bowl including of the virtual lengthwise and crosswise lines may be provided and analyzed and processed by the device (e.g. processing unit) and the identify sections which need specific cleaning such as sanitization or intensive cleaning may be clean by one of the selected spraying units (e.g. 360 or 390) or by one or more of the spraying nozzles 361", 363", 365", 367" which are in proximity to the identified section which need cleaning. One of the advantages of identifying and cleaning a specific section include energy and water saving as only specific units of the device are operated for predetermined time intervals for cleaning specific locations.

In some cases, the cleaning process may be according to a general cleaning procedure and not according to the cleaning matrix.

At step 670, following the activation of the bottom spraying unit 360 and/or once the first cleaning process is completed (for example after 8 seconds) a second cleaning process is initiated which typically comprises a sanitization procedure. According to some embodiments the second cleaning process is executed by the upper spraying unit 590 or by and/or external arm 390 to spray sanitation materials to the toilet boil cavity and/or the toilet seat and/or to the lavatory space as shown in FIG. 3I, thus providing a complete and optimal cleaning and sanitation result in minimum time.

It is noted that the first cleaning process (step 660) and/or the second cleaning process (step 670) is typically initiated once the sensors (such as the proximity sensors) confirm that the user or any person is not at the vicinity of the treatment device 100, for example, based on an indication of a movement of the toilet seat or other indications confirming that the user toilet's use is completed. Additionally, the second cleaning process (step 670) which comprises one or more sanitization procedures is activated once an indication is received confirming that the user or any person is no longer in the lavatory (for example for health reasons).

In some cases, the one or more indications such as the user movement, voice, color or the toilet seat movement are categorized and/or prioritized for example by the one or more processing units (e.g. processing unit 431 or 810) to provide secured and healthy cleaning process and avoid injuries to the user, for example the toilet seat movement indication is a secondary indication while the user movement is a substantial indication.

According to some embodiments, the cleaning device comprises different treatment programs for women and men toilets. For example, for women toilets the indications and treatment program are according to women use while for men toilets the indications and treatment program are based on men use. Based on the one or more indications the treatment device is configured to indicate in real time the exact toilet use.

Optionally at step 680 a third cleaning process which may be automatically and/or cyclically activated, for example, each hour once the indicators confirm that there isn't any person in proximity to the toilets or the treatment device. The third cleaning process may include disinfection of the toilet seat or toilet's space for example by the upper spraying unit 590 and/or external arm 390 or other spraying units or nozzles. Specifically, the disinfection comprises spraying a sanitizer which may volatilize in less than for example few seconds followed by perfuming the toilet surroundings (e.g. the toilet bowl).

In some cases, the first and/or second or any cleaning process may be autonomously stopped or repeated according to indications received by the one or more sensors of the device or by external indications received at the processing unit. For example, the proximity sensor may send an indication that a user is still at the vicinity of the toilet and therefore the processing unit will block any cleaning procedure or a cleaning procedure that might risk the user. Alternatively or in combination the processing unit may operate a cleaning procedure which will not risk the user (e.g. using only clean water). Alternatively or in combination, the processing unit may receive data, for example by the communication module not to clean the toilet and to obtain samples.

Figure 6B:
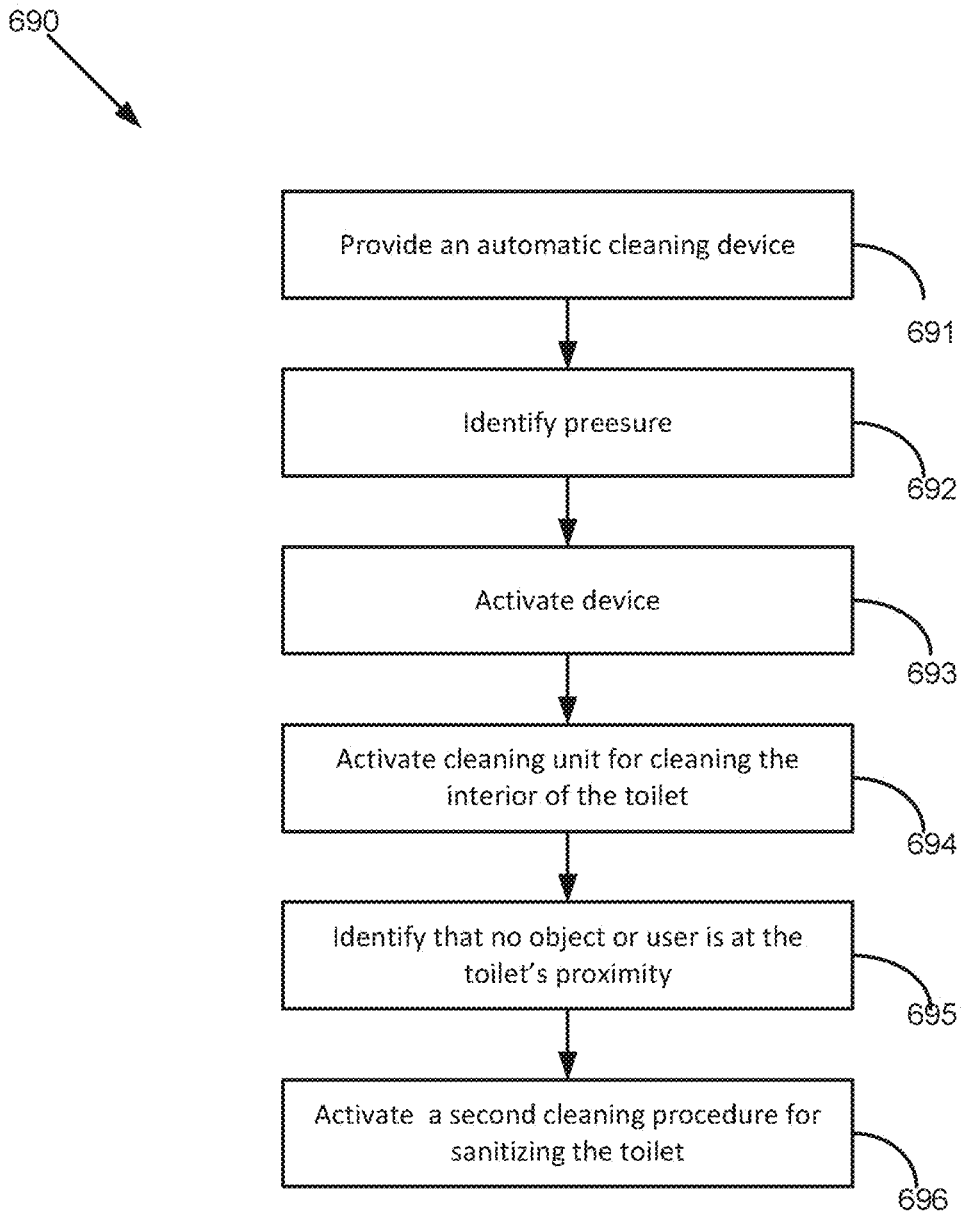

FIG. 6B is a flowchart of a method 690 automatically and/or autonomously cleaning and/or foaming and/or disinfecting toilets, in accordance with embodiments. At step 691 a treatment device such as the toilet cleaning device illustrated in FIGS. 1-5 is provided and initially installed upon a lavatory appliance, i.e. on the toilet's rim. At step 692 a pressure sensor, such as a pressure sensor configured to identify or be activated once contact or pressure on the device 100 or 150 is activated, for example, be an object's pressure, such as a toilet user pressure. At step 693 the device is activated as a result of the pressure identification. At step 694 a timer or a processing unit activates the device for a predefined time and a first cleaning procedure is activated, including for example cleaning dirt using toilet flushing water mixed with cleaning material. In some cases, the cleaning procedure may be activated by the first cleaning unit 360 which accordingly activates the sparing nozzles for cleaning the interior of a toilet. In some cases, the timer may be tuned differently for men's toilets and to women's toilets, e.g. for a short period time of 5-10 seconds for men's toilets. At step 695 a proximity sensor may identify that a user or that an object is no longer at the toilet vicinity and at step 696 a timer or the processing unit may accordingly activate a second cleaning procedure by for example the rotating arm for sanitizing the toilet as illustrated for example in FIG. 3I.

Figure 7:
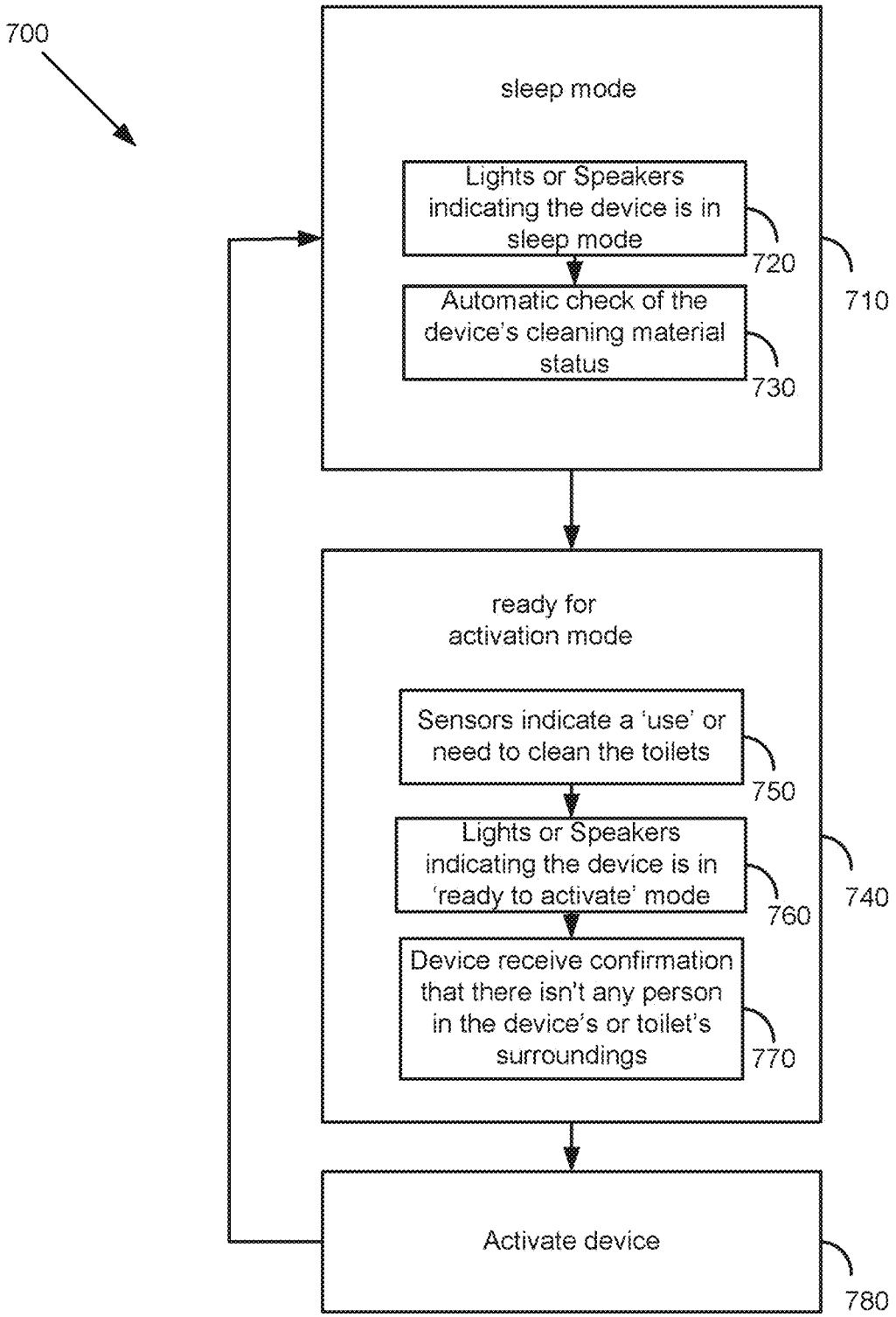
FIG. 7 is a flow chart illustrating a process of operating the treatment device, in accordance with configurations.

FIG. 7 is a flow chart illustrating in details a process 700 of operating the cleaning devices 100 or 150, in accordance with embodiments. Prior to the device activation the device is typically in sleep mode 710 where the device's units are not operated or on energy saving mode. At step 720 one or more indication lights or speakers provide information of the device's status (e.g. according to the indicator light color, or upon pushing a status indication button), confirming that the device will not be activated. In some cases, at step 730 the device may periodically operate an automatic check of the device's cleaning material status. Accordingly, the material containers may be automatically filled via one or more dedicated pipes and pumps connected to an external or an internal tank. Alternatively or in combination, the device's containers may be filled by a user. At step 740 the device's mode is transformed from 'sleep' mode to 'ready for activation' mode once the one or more sensors such as the proximity sensors indicate at step 750 a use of the toilets or a number of water flushing cycles. Accordingly, at step 760 lights or speakers indicate the device is in 'ready to activate' mode and at step 770, once the sensors confirm that that the user is no longer in proximity to the toilet bowl seat or the user completed using the toilet's the device's processor automatically activates the device at step 780 to initiate a cleaning process as illustrated in FIG. 6. For example, once the user stands or flush the toilet the first cleaning process is activated and once he leaves the toilet, the second cleaning process is activated.

Figure 8:
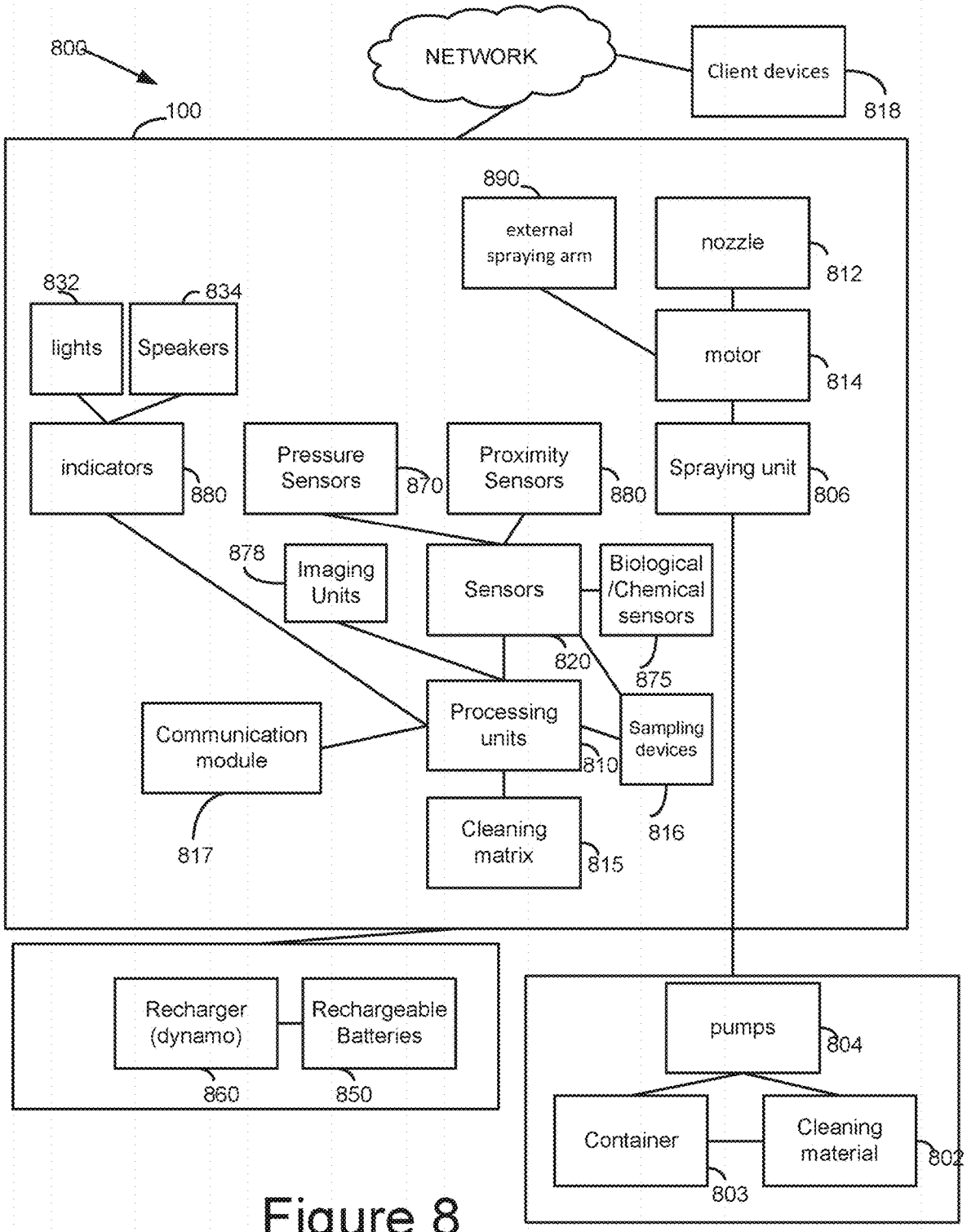
FIG. 8 shows a high level schematic block diagram illustrating elements of the device, in accordance with configurations.

FIG. 8 is a high level schematic block diagram 800 illustrating elements of the cleaning device such as device 100 or 150, according to some embodiments. The device 100 comprises one or more processing units 810 configured and enabled to operate the device according to one or more inputs or data received for example from one or more sensors, such as sensors 820. The sensors 820 may be attached or coupled for example to the bridge unit 120 and/or to treatment unit 110 and/or the storage unit 130. Alternatively or in combination the sensors 820 may be external to the device 100 for example in proximity to the toilet bowl or at one or more locations in the lavatory.

In operation, the one or more sensors 820 such as a proximity sensor 880 or a pressure sensor 870 or Biological/Chemical sensors 875 are in communication with the processing unit 810 to operate the device 100 according to one or more specific sensing indications. For example, the pressure sensor 870 may provide data which recognize that the toilet is still in use and accordingly update the processing unit 810 analyze the received data and prevents the activation of the device (e.g. prevents initiation of a cleaning process). The processing units 810 are continuously updated (e.g. in real-time) with the information and data received from the sensors and once a change such as pressure and/or movement and/or any change is measured by the pressure sensor and/or based on additional indications such as information received from the proximity sensors a cleaning process may be initiated as illustrated in FIGS. 6 and 7.

According to some embodiments, the processing units may be in communication with one or more imaging units 878 or other sensors for analyzing and diagnosing images or samples obtained by one or more sampling devices 816 such as tubulars.

Additionally or alternatively the processing units may operate and control the cleaning device according to a predetermined cleaning matrix 815 which includes the device's operation rules for controlling and monitoring the device cleaning operation. The operation rules may include, for example, conditions for operating the device, time lines, and specific type of cleaning procedures to be operated by the spraying units (e.g. upper or lower spraying units) according to the toilet's condition or cleaning matrix. In some cases, the matrix 815 may include data, provided for example by the sensors 820 in real-time, relating to specific toilet bowl's locations which require further cleaning and/or sanitization. The data may be further analyzed by the processing unit 810 which accordingly activates the appropriate spraying unit (e.g. the upper or lower spraying unit).

In some cases, the device 100 may receive information from external devices such as client devices 818, via a server network including data relating to the toilet status or commands to activate or deactivate the one or more sensors and/or imagers and/or cleaning units via a communication module 817.

The client devices may comprise, for example, desktop, laptop, or tablet computers, media consoles, personal digital assistants or smartphones, or any other sort of device with the types of network, video and audio interfaces and computing capabilities needed to interact with the network server. By way of example, the device may comprise a computer with a processor, memory, display, a user interface configured to receive a navigation command from a user, a communication module configured to communicate with the server and other units such as speakers. In some cases, the devices may be for example a mobile phone comprising a processor, display and memory.

Once a cleaning process is operated one or more indicators 831 show the device's status for example by one or more light colors 832. Specifically, a green color may indicate that the device is currently operating a cleaning process while a red color may indicate the device is in sleep mode. Alternatively or in combination, one or more speakers 834 may announce the device's cleaning operation such as 'cleaning' 'sanitization' etc.

The cleaning process as illustrated herein above in respect to FIG. 6 may comprise pumping fluids from the fluids container and spraying by pressure the water to the toilet bowl surface. Additionally, cleaning materials 802 are derived by one or more pumps 804 via one or more pipes from containers 803 located for example at the external unit or at other units such as the bridge, to the spraying unit 806. Once approved by the processing units 810 the cleaning materials 802 are sprayed via the nozzles 812 into the toilets. The spraying procedure is controlled by the processing unit by one or more motors 814 configured to rotate and move the nozzles 812 or external sparing arm 890 to spray the cleaning material 802 at specific locations such as inner toilet surface locations which require additional cleaning.

A person of ordinary skill in the art will recognize variations and adaptations that may be made to the flow as shown in FIGS. 6-8, including, but not limited to, the removal or addition of one or more components, one or more components arranged in a different order, and/or one or more components comprising subcomponents of other components.

In accordance with embodiments, the device units (e.g. device 100 or 150) such as the pumps, sensors, spraying units include communication elements or means such as wireless or wired circuity for communication with each unit and specifically with the processing unit (e.g. processing unit 431) for receiving instructions from the processing unit to be operated according to the data received from the one or more sensors.

In accordance with embodiments, the device is configured to operate with IoT hub.

In some cases the IoT hub may comprise a WAN interface to couple the IoT hub to an IoT service over the WAN, and a local communication interface to communicatively couple the IoT hub to a plurality of different types of IoT devices; and at least one IoT device having a memory for storing program code and a microcontroller for executing the program code, wherein the program code includes library program code comprising basic building blocks usable by a developer to implement any IoT device by creating application program code which utilizes the library program code, wherein at least one of the basic building blocks comprises a communication stack to enable communication with the IoT hub, the library program code provided to the developer in a software development kit (SDK) with the microcontroller as illustrated in U.S. Pat. No. 9,497,572 which incorporated herein by reference. In some cases, other IoT methods and systems may be implemented for example at the device 100 or 150 processing unit.

Figure 9:
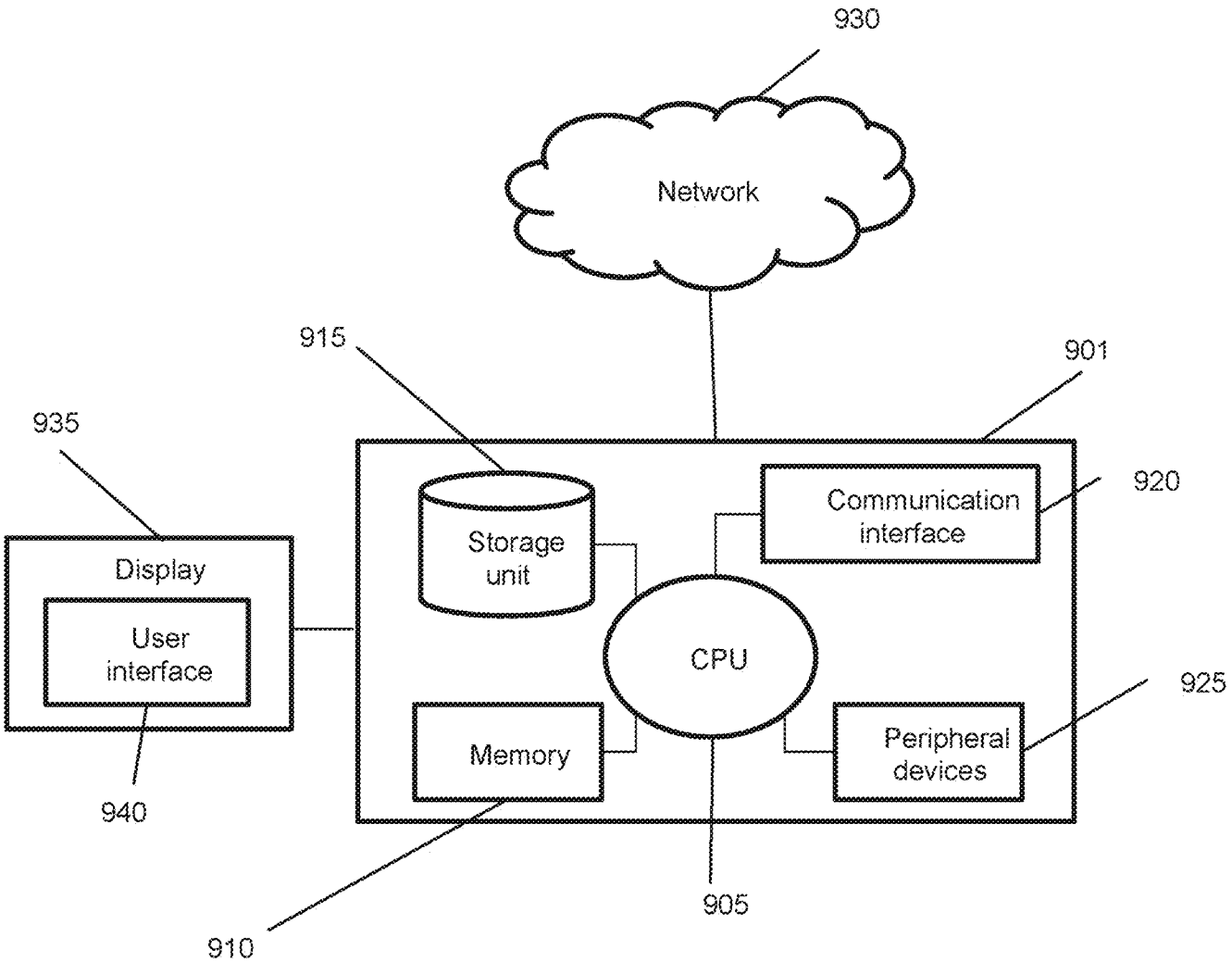
FIG. 9 shows a computer system suitable for incorporation with the methods and apparatus, in accordance with configurations.

The present disclosure provides computer control systems that are programmed to implement methods of the disclosure. FIG. 9 shows a computer system 901 suitable for incorporation with the methods and apparatus in accordance with some embodiments of the present disclosure, for example at the PCB 432. The computer system 901 can process various aspects of information of the present disclosure, such as, for example, questions and answers, responses, statistical analyses. The computer system 901 can be an electronic device of a user or a computer system that is remotely located with respect to the electronic device. The electronic device can be a mobile electronic device.

The computer system 901 includes a central processing unit (CPU, also "processor" and "computer processor" herein) 905, which can be a single core or multi core processor, or a plurality of processors for parallel processing. The computer system 901 also includes memory or memory location 910 (e.g., random-access memory, read-only memory, flash memory), electronic storage unit 915 (e.g., hard disk), communication interface 920 (e.g., network adapter) for communicating with one or more other systems, and peripheral devices 925, such as cache, other memory, data storage and/or electronic display adapters. The memory 910, storage unit 915, interface 920 and peripheral devices 925 are in communication with the CPU 905 through a communication bus (solid lines), such as a motherboard. The storage unit 915 can be a data storage unit (or data repository) for storing data. The computer system 901 can be operatively coupled to a computer network ("network") 930 with the aid of the communication interface 920. The network 930 can be the Internet, an internet and/or extranet, or an intranet and/or extranet that is in communication with the Internet. The network 930 in some cases is a telecommunication and/or data network. The network 930 can include one or more computer servers, which can enable distributed computing, such as cloud computing. The network 930, in some cases with the aid of the computer system 901, can implement a peer-to-peer network, which may enable devices coupled to the computer system 901 to behave as a client or a server.

The CPU 905 can execute a sequence of machine-readable instructions, which can be embodied in a program or software. The instructions may be stored in a memory location, such as the memory 910. The instructions can be directed to the CPU 905, which can subsequently program or otherwise configure the CPU 905 to implement methods of the present disclosure. Examples of operations performed by the CPU 905 can include fetch, decode, execute, and writeback.

The CPU 905 can be part of a circuit, such as an integrated circuit for example circuit board 432. One or more other components of the system 901 can be included in the circuit. In some cases, the circuit is an application specific integrated circuit (ASIC).

The storage unit 915 can store files, such as drivers, libraries and saved programs. The storage unit 915 can store user data, e.g., user preferences and user programs. The computer system 901 in some cases can include one or more additional data storage units that are external to the computer system 901, such as located on a remote server that is in communication with the computer system 901 through an intranet or the Internet.

The computer system 901 can communicate with one or more remote computer systems through the network 930. For instance, the computer system 901 can communicate with a remote computer system of a user (e.g., a parent). Examples of remote computer systems and mobile communication devices include personal computers (e.g., portable PC), slate or tablet PC's (e.g., Apple® iPad, Samsung® Galaxy Tab), telephones, Smart-phones (e.g., Apple® iPhone, Android-enabled device, Blackberry®), personal digital assistants, wearable medical devices (e.g., Fitbits), or medical device monitors (e.g., seizure monitors). The user can access the computer system 901 with the network 930.

Methods as described herein, can be implemented by way of machine (e.g., computer processor) executable code stored on an electronic storage location of the computer system 901, such as, for example, on the memory 910 or electronic storage unit 915. The machine executable or machine readable code can be provided in the form of software. During use, the code can be executed by the processor 905. In some cases, the code can be retrieved from the storage unit 915 and stored in the memory 910 for ready access by the processor 905. In some situations, the electronic storage unit 915 can be precluded, and machine-executable instructions are stored in memory 910.

The code can be pre-compiled and configured for use with a machine have a processer adapted to execute the code, or can be compiled during runtime. The code can be supplied in a programming language that can be selected to enable the code to execute in a pre-compiled or as-compiled fashion.

Aspects of the systems and methods provided herein, such as the computer system 401, can be embodied in programming Various aspects of the technology may be thought of as "products" or "articles of manufacture" typically in the form of machine (or processor) executable code and/or associated data that is carried on or embodied in a type of machine readable medium. Machine-executable code can be stored on an electronic storage unit, such memory (e.g., read-only memory, random-access memory, flash memory) or a hard disk. "Storage" type media can include any or all of the tangible memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the software from one computer or processor into another, for example, from a management server or host computer into the computer platform of an application server. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible "storage" media, terms such as computer or machine "readable medium" refer to any medium that participates in providing instructions to a processor for execution.

Hence, a machine readable medium, such as computer-executable code, may take many forms, including but not limited to, a tangible storage medium, a carrier wave medium or physical transmission medium. Non-volatile storage media include, for example, optical or magnetic disks, such as any of the storage devices in any computer(s) or the like, such as may be used to implement the databases, etc. shown in the drawings. Volatile storage media include dynamic memory, such as main memory of such a computer platform. Tangible transmission media include coaxial cables; copper wire and fiber optics, including the wires that comprise a bus within a computer system. Carrier-wave transmission media may take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a ROM, a PROM and EPROM, a FLASH-EPROM, any other memory chip or cartridge, a carrier wave transporting data or instructions, cables or links transporting such a carrier wave, or any other medium from which a computer may read programming code and/or data. Many of these forms of computer readable media may be involved in carrying one or more sequences of one or more instructions to a processor for execution.

The computer system 901 can include or be in communication with an electronic display 935 that comprises a user interface (UI) 940 for providing, for example, questions and answers, analysis results, recommendations. Examples of UI's include, without limitation, a graphical user interface (GUI) and web-based user interface.

Methods and systems of the present disclosure can be implemented by way of one or more algorithms and with instructions provided with one or more processors as disclosed herein. An algorithm can be implemented by way of software upon execution by the central processing unit 905. The algorithm can be, for example, random forest, graphical models, support vector machine or other.

Although the above steps show a method of a system in accordance with an example, a person of ordinary skill in the art will recognize many variations based on the teaching described herein. The steps may be completed in a different order. Steps may be added or deleted. Some of the steps may comprise sub-steps. Many of the steps may be repeated as often as if beneficial to the platform.

Each of the examples as described herein can be combined with one or more other examples. Further, one or more components of one or more examples can be combined with other examples.

In some embodiments, the cleaning device described herein includes a digital processing unit or device, or use of the same. In further embodiments, the digital processing device includes one or more hardware central processing units (CPU) that carry out the device's functions. In still further embodiments, the digital processing device further comprises an operating system configured to perform executable instructions. In some embodiments, the digital processing device is optionally connected a computer network. In further embodiments, the digital processing device is optionally connected to the Internet such that it accesses the World Wide Web. In still further embodiments, the digital processing device is optionally connected to a cloud computing infrastructure. In other embodiments, the digital processing device is optionally connected to an intranet. In other embodiments, the digital processing device is optionally connected to a data storage device.

Those of skill in the art will recognize that many smartphones are suitable for use in the system described herein. Those of skill in the art will also recognize that select televisions, video players, and digital music players with optional computer network connectivity are suitable for use in the system described herein. Suitable tablet computers include those with booklet, slate, and convertible configurations, known to those of skill in the art.

In some embodiments, the digital processing device includes an operating system configured to perform executable instructions. The operating system is, for example, software, including programs and data, which manages the device's hardware and provides services for execution of applications. Those of skill in the art will recognize that suitable server operating systems include, by way of non-limiting examples, FreeBSD, OpenBSD, NetBSD®, Linux, Apple® Mac OS X Server®, Oracle® Solaris®, Windows Server®, and Novell® NetWare®. Those of skill in the art will recognize that suitable personal computer operating systems include, by way of non-limiting examples, Microsoft® Windows®, Apple® Mac OS X®, UNIX®, and UNIX-like operating systems such as GNU/Linux®. In some embodiments, the operating system is provided by cloud computing. Those of skill in the art will also recognize that suitable mobile smart phone operating systems include, by way of non-limiting examples, Nokia® Symbian® OS, Apple® iOS @, Research In Motion® BlackBerry OS®, Google® Android®, Microsoft® Windows Phone® OS, Microsoft® Windows Mobile® OS, Linux®, and Palm® WebOS®.

In some embodiments, the device includes a storage and/or memory device. The storage and/or memory device is one or more physical apparatuses used to store data or programs on a temporary or permanent basis. In some embodiments, the device is volatile memory and requires power to maintain stored information. In some embodiments, the device is non-volatile memory and retains stored information when the digital processing device is not powered. In further embodiments, the non-volatile memory comprises flash memory. In some embodiments, the non-volatile memory comprises dynamic random-access memory (DRAM). In some embodiments, the non-volatile memory comprises ferroelectric random access memory (FRAM). In some embodiments, the non-volatile memory comprises phase-change random access memory (PRAM). In other embodiments, the device is a storage device including, by way of non-limiting examples, CD-ROMs, DVDs, flash memory devices, magnetic disk drives, magnetic tapes drives, optical disk drives, and cloud computing based storage. In further embodiments, the storage and/or memory device is a combination of devices such as those disclosed herein.

In some embodiments, the digital processing device includes a display to send visual information to a user. In some embodiments, the display is a cathode ray tube (CRT). In some embodiments, the display is a liquid crystal display (LCD). In further embodiments, the display is a thin film transistor liquid crystal display (TFT-LCD). In some embodiments, the display is an organic light emitting diode (OLED) display. In various further embodiments, on OLED display is a passive-matrix OLED (PMOLED) or active-matrix OLED (AMOLED) display. In some embodiments, the display is a plasma display. In other embodiments, the display is a video projector. In still further embodiments, the display is a combination of devices such as those disclosed herein.

In some embodiments, the digital processing device includes an input device to receive information from a user. In some embodiments, the input device is a keyboard. In other embodiments, the input device is a microphone to capture voice or other sound input. In other embodiments, the input device is a video camera to capture motion or visual input. In still further embodiments, the input device is a combination of devices such as those disclosed herein.

In some embodiments, the spectrometer system disclosed herein includes one or more non-transitory computer readable storage media encoded with a program including instructions executable by the operating system of an optionally networked digital processing device. In further embodiments, a computer readable storage medium is a tangible component of a digital processing device. In still further embodiments, a computer readable storage medium is optionally removable from a digital processing device. In some embodiments, a computer readable storage medium includes, by way of non-limiting examples, CD-ROMs, DVDs, flash memory devices, solid state memory, magnetic disk drives, magnetic tape drives, optical disk drives, cloud computing systems and services, and the like. In some cases, the program and instructions are permanently, substantially permanently, semi-permanently, or non-transitorily encoded on the media.

In some embodiments, the spectrometer system disclosed herein includes at least one computer program, or use of the same. A computer program includes a sequence of instructions, executable in the digital processing device's CPU, written to perform a specified task. Computer readable instructions may be implemented as program modules, such as functions, objects, Application Programming Interfaces (APIs), data structures, and the like, that perform particular tasks or implement particular abstract data types. In light of the disclosure provided herein, those of skill in the art will recognize that a computer program may be written in various versions of various languages.

The functionality of the computer readable instructions may be combined or distributed as desired in various environments. In some embodiments, a computer program comprises one sequence of instructions. In some embodiments, a computer program comprises a plurality of sequences of instructions. In some embodiments, a computer program is provided from one location. In other embodiments, a computer program is provided from a plurality of locations. In various embodiments, a computer program includes one or more software modules. In various embodiments, a computer program includes, in part or in whole, one or more web applications, one or more mobile applications, one or more standalone applications, one or more web browser plug-ins, extensions, add-ins, or add-ons, or combinations thereof.

In some embodiments, a computer program includes a mobile application provided to a mobile digital processing device. In some embodiments, the mobile application is provided to a mobile digital processing device at the time it is manufactured. In other embodiments, the mobile application is provided to a mobile digital processing device via the computer network described herein.

In view of the disclosure provided herein, a mobile application is created by techniques known to those of skill in the art using hardware, languages, and development environments known to the art. Those of skill in the art will recognize that mobile applications are written in several languages. Suitable programming languages include, by way of non-limiting examples, C, C++, C#, Objective-C, Java™, Javascript, Pascal, Object Pascal, Python™, Ruby, VB.NET, WML, and XHTML/HTML with or without CSS, or combinations thereof.

Suitable mobile application development environments are available from several sources. Commercially available development environments include, by way of non-limiting examples, AirplaySDK, alcheMo, Appcelerator®, Celsius, Bedrock, Flash Lite, .NET Compact Framework, Rhomobile, and WorkLight Mobile Platform. Other development environments are available without cost including, by way of non-limiting examples, Lazarus, MobiFlex, MoSync, and Phonegap. Also, mobile device manufacturers distribute software developer kits including, by way of non-limiting examples, iPhone and iPad (iOS) SDK, Android™ SDK, BlackBerry® SDK, BREW SDK, Palm® OS SDK, Symbian SDK, webOS SDK, and Windows® Mobile SDK.

Those of skill in the art will recognize that several commercial forums are available for distribution of mobile applications including, by way of non-limiting examples, Apple® App Store, Android™ Market, BlackBerry® App World, App Store for Palm devices, App Catalog for webOS, Windows® Marketplace for Mobile, Ovi Store for Nokia® devices, Samsung® Apps, and Nintendo® DSi Shop.

In some embodiments, the cleaning device disclosed herein includes software, server, and/or database modules, or use of the same. In view of the disclosure provided herein, software modules are created by techniques known to those of skill in the art using machines, software, and languages known to the art. The software modules disclosed herein are implemented in a multitude of ways. In various embodiments, a software module comprises a file, a section of code, a programming object, a programming structure, or combinations thereof. In further various embodiments, a software module comprises a plurality of files, a plurality of sections of code, a plurality of programming objects, a plurality of programming structures, or combinations thereof. In various embodiments, the one or more software modules comprise, by way of non-limiting examples, a web application, a mobile application, and a standalone application. In some embodiments, software modules are in one computer program or application. In other embodiments, software modules are in more than one computer program or application. In some embodiments, software modules are hosted on one machine. In other embodiments, software modules are hosted on more than one machine. In further embodiments, software modules are hosted on cloud computing platforms. In some embodiments, software modules are hosted on one or more machines in one location. In other embodiments, software modules are hosted on one or more machines in more than one location.

In some embodiments, the cleaning device disclosed herein includes one or more databases, or use of the same. In view of the disclosure provided herein, those of skill in the art will recognize that many databases are suitable for storage and retrieval of information as described herein. In various embodiments, suitable databases include, by way of non-limiting examples, relational databases, non-relational databases, object oriented databases, object databases, entity-relationship model databases, associative databases, and XML databases. In some embodiments, a database is internet-based. In further embodiments, a database is web-based. In still further embodiments, a database is cloud computing-based. In other embodiments, a database is based on one or more local computer storage devices.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only. The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention may be implemented in the testing or practice with methods and materials equivalent or similar to those described herein.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A device for cleaning a toilet having a toilet bowl, the device comprising:

a treatment unit comprising:

a housing having a cavity configured and enabled to collect and store flushing tank fluids of said toilet flowing via one or more openings in said housing;

one or more cleaning materials;

a spraying unit comprising one or more spraying devices, wherein said spraying devices are configured and enabled to spray said flushing tank fluids mixed with the cleaning materials via the one or more spraying devices into an interior of the toilet bowl;

one or more pumps for drawing said flushing tank fluids mixed within the treatment unit with the one or more cleaning materials to the spraying unit.

2. The device of claim 1, further comprising:

a storage and control unit, comprising:

at least one container, said at least one container is configured to store one or more cleaning materials of another type for cleaning or sanitizing said toilet;

one or more pumps for delivering via one or more pipes said one or more cleaning materials of another type; and one or more power sources.

3. The device of claim 1, wherein said treatment unit comprises a rotatable spraying unit configured to:

receive cleaning materials of said another type from said one or more pipes;

rotate perpendicularly in respect to said treatment unit length at said toilet bowl cavity; and spray said one or more cleaning materials at said toilet bowl cavity.

4. The device of claim 3, further comprising:

one or more sensors configured and enabled to collect data relating to said toilet or areas surrounding said toilet;

one or more processing units configured to:

receive the data from said one or more sensors;

process the data relating to the toilet or the toilet surrounding conditions and operate the spraying devices or the rotatable spraying unit to provide said one or more cleaning materials according to the processed data.

5. The device of claim 4, wherein the data comprises one or more indications of a presence of an object or a user in proximity to the device or the toilet bowl and the one or more processing units are configured to activate the spraying devices or the rotatable spraying unit once the user is not in the vicinity of the toilet.

6. The device of claim 4, wherein the sensors are selected from the group consisting of: proximity sensors; pressure sensors; RF sensors; IR sensors; laser sensors; biologic sensors; image sensors; spectroscopic sensors; sensors configured to detect smell, PH sensors.

7. The device of claim 4, wherein the one or more processing units are configured to initiate a first cleaning process according to one or more indications received from said sensors.

8. The device of claim 7, wherein the processing units are configured to initiate a second cleaning process following said first cleaning process or according to one or more indications received from said sensors.

9. The device of claim 8, wherein said second cleaning process comprises activation said rotatable spraying unit.

10. The device of claim 9, wherein said second cleaning process comprises spaying one or more sanitization materials.

11. The device of claim 7, wherein said first cleaning process comprises:

activating the spraying unit; and spraying fluids and cleaning materials into the toilet bowl.

12. The device of claim 3, wherein the one or more spraying devices or rotatable spraying unit comprises a spray nozzle.

13. The device of claim 12, wherein said spray nozzle is configured and enabled to rotate or move.

14. The device of claim 3, wherein the treatment unit comprises an elongated groove, and wherein said rotatable spraying unit is embedded within said elongated groove.

15. The device of claim 1, further comprising:

a bridge unit connectable to said treatment unit and said storage and control unit, wherein said bridge unit is configured and enabled to be hung on said toilet bowl rim and hold said treatment unit away and below the toilet bowl rim at the path of the toilet flushing water.

16. The device of claim 1, further comprising one or more indicators units.

17. The device of claim 16, wherein the one or more indicator units are configured to present the status of the device.

18. The device of claim 1, further comprising hydropower means to provide power to said cleaning device.

19. The device of claim 18, wherein the hydropower means comprises a dynamo unit for producing hydroelectricity to charge a power source connected to said cleaning device.

20. The device of claim 1, wherein said treatment unit comprises at least one treatment container, said at least one treatment container is configured and enabled to collect and store fluids, wherein said fluids are toilet flushing tank fluids.

* * * * *